US006970162B2

(12) United States Patent
Murayama et al.

(10) Patent No.: US 6,970,162 B2
(45) Date of Patent: Nov. 29, 2005

(54) IMAGE DISPLAY APPARATUS

(75) Inventors: Kazuhiko Murayama, Kanagawa (JP); Tadashi Aoki, Kanagawa (JP); Aoji Isono, Kanagawa (JP); Kenji Shino, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 463 days.

(21) Appl. No.: 10/211,521

(22) Filed: Aug. 5, 2002

(65) Prior Publication Data

US 2003/0038792 A1 Feb. 27, 2003

(30) Foreign Application Priority Data

Aug. 3, 2001 (JP) ..... 2001-237027
Apr. 19, 2002 (JP) ..... 2002-118296

(51) Int. Cl.[7] ..... G09G 5/00
(52) U.S. Cl. ..... 345/211; 345/42; 345/52; 345/75.2
(58) Field of Search ..... 345/74.1, 75.1, 345/75.2, 41, 42, 211; 313/326, 483, 305–311, 313/169.1, 169.2, 169.3, 169.4; 445/24

(56) References Cited

U.S. PATENT DOCUMENTS

| | | | | |
|---|---|---|---|---|
| 4,904,895 A | | 2/1990 | Tsukamoto et al. | 313/336 |
| 5,481,447 A | * | 1/1996 | Caris et al. | 363/60 |
| 5,936,597 A | * | 8/1999 | Hyun et al. | 345/74.1 |
| 5,986,389 A | | 11/1999 | Tsukamoto | 313/310 |
| 6,040,809 A | * | 3/2000 | Friedman | 345/74.1 |
| 6,097,359 A | * | 8/2000 | Kwon et al. | 345/74.1 |
| 6,147,449 A | | 11/2000 | Iwasaki et al. | 313/495 |
| 6,171,162 B1 | | 1/2001 | Iwasaki et al. | 445/6 |
| 6,184,610 B1 | | 2/2001 | Shibata et al. | 313/309 |
| 6,231,413 B1 | | 5/2001 | Tsukamoto | 445/24 |
| 6,246,168 B1 | | 6/2001 | Kishi et al. | 313/495 |
| 6,288,494 B1 | | 9/2001 | Tsukamoto et al. | 315/169.1 |
| 6,472,814 B1 | | 10/2002 | Yamanobe et al. | 313/495 |
| 6,683,602 B1 | * | 1/2004 | Hioki | 345/204 |

FOREIGN PATENT DOCUMENTS

| | | |
|---|---|---|
| JP | 7-197325 | 8/1995 |
| JP | 9-188509 | 7/1997 |
| JP | 2000-95509 | 4/2000 |
| JP | 2000-250475 | 9/2000 |

OTHER PUBLICATIONS

Young Chul Choi et al., *Controlling the Diameter, Growth Rate, and Density of Vertically Aligned Carbon Nanotubes Synthesized by Microwave Plasma-enhanced Chemical Vapor Deposition*, Applied Physics Letter, vol. 76, No. 17, (Apr. 2000) pp. 2367-2369.
Sumio Lijima, *Helical Microtubules of Graphitic Carbon*, Letters to Nature, vol. 354 (Nov. 1991), pp. 56-58.
Andreas Thess et al., *Crystalline Ropes of Metallic Carbon Nanotubes*, Science, vol. 273, (Jul. 1996) pp. 483-487).

* cited by examiner

*Primary Examiner*—Henry N. Tran
(74) *Attorney, Agent, or Firm*—Fitzpatrick, Cella, Harper & Scinto

(57) ABSTRACT

An image display apparatus having a plurality of image forming devices. In an output circuit provided between constant voltage supplies and wiring for driving each of the image forming devices, MOSFETs are successively turned on from the one having a higher ON resistance at the time of switching to make a stepwise transition between outputs from the constant voltage supplies, and have steady potential, thereby limiting undesirable variation in signal potential at the time of switching.

5 Claims, 18 Drawing Sheets

IMAGE DISPLAY APPARATUS

BACKGROUND OF THE INVENTION

1. Field of the Invention

The present invention relates to an image display apparatus having a plurality of image forming devices.

2. Description of the Related Art

There are known two types of electron-emitting devices: a hot cathode device and a cold cathode device. For example, as cold cathode devices, a field emission type (hereinafter referred to as "FE type") of device, a metal/insulator/metal type (hereinafter referred to as "MIM type") of electron-emitting device, a surface conduction type of electron-emitting device are known.

A surface conduction electron-emitting device is simple in structure and can be easily manufactured. Therefore it has the advantage of constituting an array in which a multiplicity of devices are formed over a large area. Methods for arranging a multiplicity of devices and driving the devices, e.g., one disclosed in JP 64-3132 A are being studied. For example, as applications of surface conduction electron-emitting devices, image forming apparatuses such as image display apparatuses and image recording apparatuses, charged beam sources, etc., are being studied.

In particular, image display apparatuses, such as those disclosed in U.S. Pat. No. 5,066,883 B and JP 2-257551 A are which use a combination of a surface-conduction electron-emitting device and a phosphor capable of emitting light when irradiated with an electron beam, are being studied for application of surface conduction electron-emitting devices. It is expected that image display apparatuses using a combination of a surface conduction electron-emitting device and a phosphor will have improved characteristics in comparison with the other types of conventional image display apparatuses. For example, even in comparison with liquid crystal displays which have recently come into widespread use, image display apparatuses using a combination of a surface conduction electron-emitting device and a phosphor are more advantageous because they can be used without a backlight and have a wider viewing angle.

FIG. 14 shows a multi-electron source formed by using an electrical wiring method. The multi-electron source shown in FIG. 14 has a multiplicity of surface conduction electron-emitting devices provided as image forming devices and which are arranged two-dimensionally, and wiring which connects these devices in matrix form. In FIG. 14, reference numeral 4001 represents the surface conduction electron-emitting devices shown schematically, lines in row wiring (scanning wiring) are indicated by 1003, and lines in column wiring (modulation wiring) are indicated by 1004. Each of row wiring lines 1003 and column wiring lines 1004 actually has a finite electrical resistance, which is shown in the figure as a wiring resistance 4004 or 4005. Wiring such as that shown in FIG. 14 is called passive matrix wiring.

Surface conduction electron-emitting devices used as electron-emitting devices 4001 are generally divided into planar-type devices and vertical-type devices. A planar-type device is constructed in such a manner that a pair of device electrodes formed as a cathode electrode and a gate electrode are disposed substantially horizontally and the direction of emission of electrons from the device is approximately perpendicular to the horizontal surface of the device. A vertical-type device is constructed in such a manner that a cathode electrode and a gate electrode are disposed substantially vertically and the direction of emission of electrons is generally parallel to the vertical plane.

A conductive thin film is formed between the cathode electrode and the gate electrode. When an device current is caused to flow through the path between the pair of electrodes, electrons are emitted from electron emitting portions which are fine fissures formed in the thin film. The conductive thin film is formed of a material selected from various materials, for example, metals, such as Pd, Pt, Ru, Ag, Au, Ti, In, Cu, Cr, Fe, Zn, Sn, Ta, W, and Pb; oxides, such as PdO, $SnO_2$, $In_2O_3$, PbO, and $Sb_2O_3$; borides, such as $HfB_2$, $ZrB_2$, $LaB_6$, $CeB_6$, $YB_4$, and $GdB_4$; carbides, such as TiC, ZrC, HfC, TaC, SiC, and WC; nitrides, such as TiN, ZrN, HfN; semiconductors, such as Si and Ge; and carbon.

Needless to say, the scale of the matrix is not limited to that of the 6×6 matrix which is illustrated for the sake of convenience. For example, in the case of a multi-electron source for an image display apparatus, a certain number of devices for display of the desired image are arranged and wired. In a multi-electron source having surface conduction electron-emitting devices wired by passive matrix wiring, suitable electrical signals are applied to row wiring 1003 and column wiring 1004 to output desired electron beams. FIGS. 15A to 15D show examples of drive waveforms for driving surface conduction electron-emitting devices in a matrix.

FIG. 15A shows the voltage waveform of a selected potential applied to a selected row wiring line, FIG. 15B shows the voltage waveform of a modulation signal applied to a column wiring line, FIG. 15C shows the voltage waveform applied to a selected device, and FIG. 15D shows the voltage waveform applied to an unselected device.

Referring to FIG. 14, a selected potential Vs is applied to the row wiring line 1003 corresponding to one of the rows selected, while a non-selected potential Vns is applied to the row wiring lines 1003 corresponding to the rows unselected. In synchronization with the application of these potentials, a modulation signal Ve for outputting an electron beam is applied to each of the column wiring lines 1004. With this method, if the voltage drops due to the wiring resistances 4004 and 4005 are ignored, a voltage Ve−Vs, which is the potential difference between the selected potential and the potential of the modulation signal, is applied to the surface conduction electron-emitting devices in the selected row, while a voltage Ve−Vns, which is the potential difference between the non-selected potential and the potential of the modulation signal, is applied to the surface conduction electron-emitting devices in the unselected rows.

The surface conduction electron-emitting device has such a characteristic as to emit electrons only when the voltage applied to the device exceeds a threshold value, and also has such a characteristic that each of the device current (current flowing through the path between the two electrodes of the device) and the electron emission current (electron beam output intensity) increases monotonously with respect to the voltage applied to the device.

Therefore, the following statements can be obtained: if Ve, Vs, and Vns are set to suitable values, an electron beam having the desired intensity can be output only from the surface conduction electron-emitting devices in the selected row; if modulation signals varying in potential are applied to the column wiring lines, electron beams having different intensities are respectively output from the devices in the selected row; and since the response speed of the surface conduction electron-emitting device is high, the time during which the electron beam is output can be changed by changing the time for application of the modulation signal.

Various applications of multi-electron sources in which surface conduction electron-emitting devices are wired by passive matrix wiring, and in which the above-described various characteristics are utilized, are conceivable. For example, applications multi-electron source of this type to image display apparatuses using a method of suitably applying a voltage signal according to image information can be expected.

FIG. 16 is a schematic plan view of an image display apparatus in which surface conduction electron-emitting devices are wired by passive matrix wiring.

Referring to FIG. 16, the image display apparatus has a substrate 7, an image display portion 1 formed by connecting a plurality of surface conduction electron-emitting devices 2 in matrix form by a plurality of row wiring lines 6 and a plurality of column wiring lines 5, scanning circuits 4 serving as a scanning means for performing scanning by selectively applying a selected potential to one of the plurality of row wiring lines 6 and by changing the selected row wiring one by one, and modulation circuits 3 serving as a modulation means for obtaining modulation signals by controlling and modulating outputs from a plurality of constant voltage supplies according to an input image signal and for applying the modulation signals to the plurality of column wiring lines 5.

FIG. 17 is a schematic perspective view of the structure of a main portion of the image display apparatus shown in FIG. 16.

There are provided a metal back 8, a phosphor layer 9, and a substrate 10. As described above, electrons are emitted from the surface conduction electron-emitting device 2 by applying the modulation signal Ve to the column wiring line 5 and the selected potential Vs to the row wiring line 6, respectively. An acceleration voltage Va is applied to the metal back 8 provided above the surface conduction electron-emitting device 2. Part of electrons emitted from the surface conduction electron-emitting device 2 are accelerated by the acceleration voltage Va to reach the phosphor layer 9. The phosphor layer 9 thereby emits light for forming an image.

Electron-emitting devices using an emitter cone and MIM-type electron-emitting devices are known as well as the surface conduction type. An arrangement in which an electroluminescence device is used as an image forming device is also known.

As an arrangement for driving image display apparatuses using such image forming devices, a matrix drive method is known. A plurality of scanning signal lines and a plurality of modulation signal lines form matrix wiring, and image forming devices are driven in such a manner that modulation signals are simultaneously or successively applied through the plurality of modulation signal lines to image forming devices to which a selected potential is applied through the scanning wiring to which a scanning signal (selected potential) is applied.

Several arrangements for applying a scanning signal and a modulation signal are also known. For example, an arrangement for applying a modulation signal at a constant current (causing a current to flow at a desired value) and an arrangement for applying a modulation signal at a constant voltage are known. For example, JP 9-319327 A discloses an arrangement using a combination of a current supply and a voltage supply. As modulation methods, an arrangement for modulating the wave height value of a modulation signal, an arrangement for modulating the pulse width of a modulation signal, and an arrangement for using wave height value modulation and pulse width modulation in combination are known.

A known art disclosed in JP 2000-310966 A relates to the present invention. In an image display apparatus in accordance with this art, two transistors are first turned on at the time of fall of a signal to cause an abrupt fall of the signal and one of the transistors is then turned off to cause the signal to fall moderately.

Disclosed in JP 5-232907 A is a reset circuit which can be used in an image display apparatus. In this reset circuit, a certain impedance value during operation is changed to a lower impedance value to reduce the peak current value.

Disclosed in JP 8-190878 A is an arrangement in which a termination circuit using a resistor, a voltage dividing circuit, or a clamp circuit using a diode is added to input and termination terminals in wiring to prevent an increase in voltage exceeding a rated limit.

SUMMARY OF THE INVENTION

An object of the present invention is to provide an arrangement capable of limiting undesirable variation in potential of a signal applied to wiring in the image display apparatus.

Another object of the present invention is to provide an arrangement capable of changing an operating condition of a circuit for applying a signal to an optimum one.

An example of a phenomenon in which an undesirable variation in potential occurs will be described with respect to an image display apparatus in which surface conduction electron-emitting devices are wired by passive matrix.

When the level of voltage output from a modulation circuit is changed by switching, a voltage at a point in nearby wiring is changed. This phenomenon will be described with reference to FIGS. 16 and 18.

FIGS. 18A and 18B shows output waveforms of modulation signals output from modulation circuits 3 and 3A. The waveform of the output from the modulation circuit 3 is shown in FIG. 18A, and the waveform of the output from the modulation circuit 3A is shown in FIG. 18B.

FIG. 18 illustrates a situation in which each of the output potentials of the modulation circuits 3 and 3A is caused to make a transition from Vne to Ve at a time T0 and only the output potential of the modulation circuit 3 is thereafter caused to make a transition from Ve to Vne at a time T1.

At this time (when the output potential of the modulation circuit 3 is changed by switching), an undesirable spike noise ΔVe is caused in the output waveform from the modulation circuit 3A, as shown in FIG. 18B. A main cause of generation of this noise is a current caused to flow abruptly through a piece of wiring at the time of voltage switching. From this current, an induced current is caused by mutual capacitance and mutual inductance between this and other pieces of wiring, resulting in an undesirable change in voltage.

If the level of such spike noise is high, a voltage higher than a rated limit is applied to the electron-emitting device or the drive circuit to cause degradation in characteristics or breakdown of the electron-emitting device, a breakdown of the drive circuit due to latch-up, electromagnetic radiation to the outside of the display apparatus, etc.

An example of a case where a surface conduction electron-emitting device is used as an image forming device and the levels of a plurality of modulation signals fall at different times has been described. However, it is also desirable to limit such an undesirable change in potential in the case of use of any other image forming device. Also, an undesirable change in potential (particularly at a high frequency) by a transition to a desired potential should be limited not only at the time of fall of a modulation signal but also at the time of rise of a modulation signal. The same can also be said with respect to a scanning signal.

To achieve the above-described objects, according one aspect of the present invention, there is provided an image display apparatus including: wiring; a circuit which applies a predetermined potential to the wiring as a potential of a signal to be supplied to the wiring; an image forming device which is set in a driven state when a voltage is applied to the image forming device by supplying the signal to the wiring, wherein the circuit is set in such a state that a connection is made via a predetermined resistance between a constant-potential supply route for supplying a constant potential to the circuit and the wiring at least one of a time when the predetermined potential is applied and a time when application of the predetermined potential is terminated, and a connection is thereafter made between the constant-potential supply route and the wiring via a resistance which is lower than the above-mentioned predetermined resistance.

A device selected from various kinds of image forming devices can be used as the image forming device driven by supplying the signal to the wiring. For example, an electron-emitting device can be used. An electroluminescence device or a liquid crystal device can be used as well as an electron-emitting device. If an electron-emitting device is used, an image may be displayed by placing together with the electron-emitting device a light emitting material (e.g., a phosphor) which emits light by electrons emitted by the electron-emitting device.

A wiring which is connected to a power source can be used as the constant-potential supply route.

According to the present invention, high-frequency variation in the potential applied to the wiring is limited. Therefore, the present invention can be suitably applied to an arrangement using a cold cathode type of electron-emitting device, which is an image forming device sensitive to variation in potential, particularly a surface conduction electron-emitting device or an electroluminescence device. As the image forming device, a device which is driven by application of voltage (potential difference) may be used.

The signal is supplied to the wiring as the potential applied to the wiring changes. That is, the image forming device driven by application of the voltage is driven by application of a voltage given as a potential difference between the predetermined potential of the signal referred to herein and another potential for supplying the voltage as a potential difference from the predetermined potential of the signal referred to herein (for example, in the case of an arrangement in which matrix drive for driving a plurality of the image forming devices is performed by using a plurality of scanning wiring lines and a plurality of modulating wiring lines (which scanning wiring lines and modulating wiring lines form matrix wiring), the above-mentioned another potential can be given as a potential of a scanning signal if the signal referred to herein is a modulation signal in the matrix drive, and the above-mentioned another potential can be given as a potential of a modulation signal if the signal referred to herein is a scanning signal in the matrix drive). The predetermined potential may comprise a plurality of potentials.

In the circuit, if the connection via the predetermined resistance is made between the constant-potential supply route for supplying the constant potential to the circuit and the wiring when the predetermined potential is applied, and if the connection via the resistance lower than the predetermined resistance is thereafter made between the constant-potential supply route and the wiring, the difference between the predetermined potential and the potential supplied via the constant-potential supply route corresponds to the voltage drop across the lower resistance. In the circuit, if the connection via the predetermined resistance is made between the constant-potential supply route for supplying the constant potential to the circuit and the wiring when application of the predetermined potential is terminated, and if the connection via the resistance lower than the predetermined resistance is thereafter made between the constant-potential supply route and the wiring, the difference between a potential applied to the wiring after the termination of application of the predetermined potential and the potential supplied via the constant-potential supply route corresponds to the voltage drop across the lower resistance. In the circuit, if the connection via the predetermined resistance is made between the constant-potential supply route for supplying the constant potential to the circuit and the wiring when the predetermined potential is applied and when application of the predetermined potential is terminated, and if the connection via the resistance lower than the predetermined resistance is thereafter made between the constant-potential supply route and the wiring, it is preferable to provide a constant-potential supply route for setting of the predetermined potential (a route for supplying a constant potential with a potential difference from the predetermined potential equal to the voltage drop) and a constant-potential supply route for a potential applied to the wiring after the termination of application of the predetermined potential (a route for supplying a constant potential with a potential difference from the potential applied to the wiring after the termination of application of the predetermined potential, which potential difference is equal to the voltage drop).

The circuit may have a plurality of parallel connection routes provided between the constant-potential supply route and the wiring, and may be arranged to realize the plurality of the above-mentioned states by changing the states of connection of the plurality of connection routes.

Preferably, the resistance value of one of the plurality of connection routes in the state where the constant-potential supply route and the wiring are connected to each other is different from the resistance value of another of the plurality of connection routes in the state where the constant-potential supply route and the wiring are connected to each other.

If three or more connection routes are provided, the resistance values of all the routes (in the connected state) may be set different from each other.

If a plurality of connection routes having different resistance values in the connected state are used, the resistance value at the beginning of the operation for setting the predetermined potential or terminating application of the predetermined potential can easily be increased to a sufficiently large value. The resistance value in the state where the connection via the predetermined resistance is made between the constant-potential supply route and the wiring may be set larger than twice the resistance value in the subsequent state where the connection via the resistance lower than the predetermined resistance is made between the constant-potential supply route and the wiring (or at least 2.1 times larger), thereby limiting undesirable variation in potential particularly advantageously. It is possible to easily satisfy this condition by using a plurality of connection routes having different resistance values in the connected state.

Each of the plurality of connection routes may have a switch and the state of connection of each connection route may be changed by the switch. A configuration including a transistor is suitably adopted as this switch. The ON resistances of the transistors used as the switches may be set different from each other to enable the connection routes to have different resistance values.

Preferably, at least one of the plurality of connection routes has an n-channel transistor and a p-channel transistor connected in parallel between the constant-potential supply route and the wiring.

In such a case, one connection route is formed of a route connecting the constant-potential supply route and the wiring and using the n-channel transistor as a switch and another route connecting the constant-potential supply route and the wiring and using the p-channel transistor as a switch.

Preferably, in the circuit, the resistance value in the state where the connection via the predetermined resistance is made between the constant-potential supply route and the wiring is set at least 2.1 times larger than the resistance value in the subsequent state where the connection via the resistance lower than the predetermined resistance is made between the constant-potential supply route and the wiring.

Preferably, a plurality of pieces of the wiring are provided and a plurality of the circuits are provided in correspondence with the plurality of pieces of the wiring.

Preferably, the plurality of pieces of the wiring comprise modulation signal lines for applying the above-mentioned signal as a modulation signal to each of the image forming devices, and also comprise a plurality of scanning signal lines for applying a scanning signal for matrix drive.

According to another aspect of the present invention, there is provided an image display apparatus including: wiring; a circuit which applies a predetermined potential to the wiring as a potential of a signal to be supplied to the wiring; an image forming device which is set in a driven state when a voltage is applied to the image forming device by supplying the signal to the wiring, wherein the circuit has a plurality of elements for controlling the states of connection between a constant-potential supply route for supplying a constant potential to the circuit and the wiring, the plurality of elements being connected in parallel with each other between the constant-potential supply route and the wiring; and the circuit is set in such a state that a part of the plurality of elements connect the constant-potential supply route and the wiring at least one of a time when the predetermined potential is applied and a time when application of the predetermined potential is terminated, and the above-mentioned part of the plurality of elements and the other of the plurality of devices connect the constant-potential supply route and the wiring.

According to still another aspect of the present invention, there is provided an image display apparatus including: wiring; a circuit which applies a predetermined potential to the wiring as a potential of a signal to be supplied to the wiring; an image forming device which is set in a driven state when a voltage is applied to the image forming device by supplying the signal to the wiring, the circuit having: a final output section which outputs the signal to the wiring; a prestage output section which is connected as a stage before the final output section, and which outputs a control signal for on/off control of the final output section; and a power supply which supplies a potential to the prestage output section, wherein the final output section has such a characteristic that its ON resistance is determined according to the amplitude value of the control signal input from the prestage output section; and the prestage output section has a final output section control circuit which changes the amplitude of the control signal according to the potential supplied from the power supply.

Preferably, the power supply comprises a variable power supply capable of changing the potential to be supplied, and a constant power supply for supplying a predetermined potential; and the final output section control circuit includes a power supply change circuit which selectively outputs the potentials supplied from the variable power supply and the constant power supply.

Preferably, the final output section has a first MOSFET and a second MOSFET having a channel characteristic different from that of the first MOSFET, the first and the second MOSFETs being connected in parallel with each other between the power supply for supplying the signal and the wiring; the power supply comprises first and second variable power supplies capable of changing potentials to be supplied, and first and second constant power supplies for supplying predetermined potentials; and the prestage output section includes a first power supply change circuit which selectively outputs the potentials from the first variable power supply and the first constant power supply to a gate terminal of the first MOSFET, a second power supply change circuit which selectively outputs the potentials from the second variable power supply and the second constant power supply to a gate terminal of the second MOSFET, and a control signal inverting circuit which diverges a prestage output section control signal externally supplied for control of the prestage output section to input to the second power supply change circuit a signal inverted relative to the signal input to the first power supply change circuit.

Preferably, at least one of the first and the second power supply change circuits is constituted of a MOSFET.

Preferably, the final output section includes a first final output section having a first MOSFET and a second MOSFET having a channel characteristic different from that of the first MOSFET, the first and the second MOSFETs being connected in parallel with each other between a first power supply for supplying the signal and the wiring, and a second final output section having a third MOSFET and a fourth MOSFET having a channel characteristic different from that of the third MOSFET, the third and fourth MOSFETs being connected in parallel with each other between a second power supply for supplying the signal and the wiring; the prestage output section includes a first prestage output section which outputs a first control signal to the first final output section, and a second prestage output section which outputs a second control signal to the second final output section; the power supply comprises, as power supplies connected to the first prestage output section, first and second variable power supplies capable of changing potentials to be supplied, and first and second constant power supplies for supplying predetermined potentials, and, as power supplies connected to the second prestage output section, third and fourth variable power supplies capable of changing potentials to be supplied, and third and fourth constant power supplies for supplying predetermined potentials; the first prestage output section includes a first power supply change circuit which selectively outputs the potentials from the first variable power supply and the first constant power supply to a gate terminal of the first MOSFET, a second power supply change circuit which selectively outputs the potentials from the second variable power supply and the second constant power supply to a gate terminal of the second MOSFET, and a first control signal inverting circuit which diverges a first prestage output section control signal externally supplied for control of the first prestage output section to input to the second power supply change circuit a signal inverted relative to the signal input to the first power supply change circuit; and the second prestage output section includes a third power supply change circuit which selectively outputs the potentials from the third variable power supply and the third constant power supply to a gate terminal of the third MOSFET, a fourth power supply change circuit which selectively outputs the potentials from the fourth variable power supply and the fourth constant power supply to a gate terminal of the fourth MOSFET, and a second control signal inverting circuit which diverges a second prestage output section control signal externally supplied for control of the second prestage output section to input to the fourth power supply change circuit a signal inverted relative to the signal input to the third power supply change circuit.

Preferably, at least one of the first to fourth power supply change circuits is constituted of a MOSFET.

Preferably, a plurality of scanning wiring lines arranged in one of row and column directions and a plurality of modulating wiring lines arranged in the other of the row and column directions are provided, and the circuit applies the predetermined potential to one of the group of scanning wiring lines and the group of modulating wiring lines.

Preferably, a scanning device for selecting one of the scanning wiring lines is provided.

DESCRIPTION OF THE PREFERRED EMBODIMENTS

Preferred embodiments of the present invention will be described with reference to the accompanying drawings. The size, material, shape, relative placement, etc., of components in the embodiments described below are shown with no intention of limiting the scope of the invention, unless specially noted as limitations to the invention.

The following description will be made mainly of the configuration of a modulation circuit representing an embodiment of the present invention and the operation of the circuit. The modulation circuit in each of the embodiments described below can be suitably used in an image display apparatus in which a plurality of image forming devices are wired by passive matrix wiring having a plurality of row wiring lines (scanning wiring lines) and a plurality of column wiring lines (modulating wiring lines), the modulation circuit being used as means for producing an output signal to be output to each of the plurality of column wiring lines by changing a plurality of constant voltage supplies according to an input image signal. As the entire configuration of the image display apparatus, any of the arrangements described above in the description of the related art and other well-known arrangements can be suitably used. Therefore the entire configuration of the image display apparatus will not be described in detail in this specification.

(First Embodiment)

The first embodiment of the present invention will be described with reference to FIG. 1.

Figure 1:
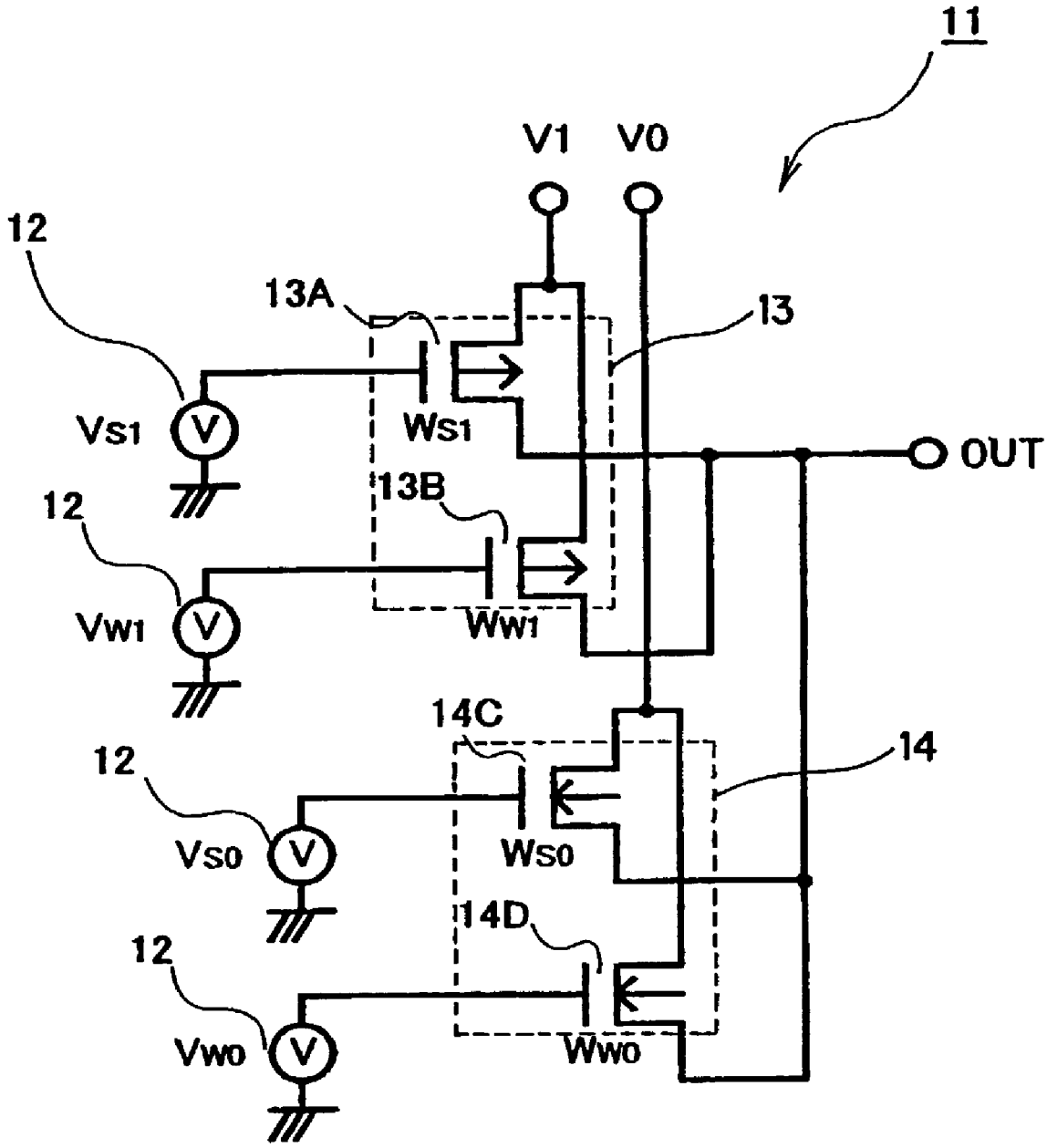
FIG. 1 is a circuit diagram schematically showing the configuration of a main portion of a modulation circuit according to a first embodiment of the present invention.

FIG. 1 is a circuit diagram schematically showing the configuration of a main portion of a modulation circuit provided in an image display apparatus of this embodiment.

An output circuit 11 shown in FIG. 1 controls outputs from a plurality of constant voltage supplies V1 and V2 according to an input image signal to obtain a modulation signal and outputs the modulation signal to a column wiring line. The output circuit 11 has an output section 13 formed as a switching means for on/off control of the output from the constant voltage supply V1, and an output section 14 formed as a switching means for on/off control of the output from the constant voltage supply V0.

The output section 13 connected to the constant voltage supply V1 is constituted of two switching devices. A transistor can be suitably used as each switching device. In this embodiment, a p-channel MOSFET (MOS-type field effect transistor), for example, is used.

MOSFETs differing in ON resistance from each other are selected as two MOSFETs 13A and 13B. More specifically, if the ON resistance of the MOSFET 13A is R13A and the ON resistance of the MOSFET 13B is R13B, the MOSFETs are selected so as to satisfy a relationship:

R13A<R13B.

The two MOSFETs 13A and 13B are connected in parallel with each other. The voltage from the constant voltage supply V1 is supplied to a source terminal of each MOSFET. A drain terminal of each MOSFET is connected to a column wiring terminal "OUT". Back gate terminals of the two MOSFETs 13A and 13B are connected to the highest potential in the circuit. A gate terminal of the MOSFET 13A is connected to a control power supply 12 (voltage Vs1), and a gate terminal of the MOSFET 13B is connected to the control power supply 12 (voltage Vw1).

That is, when a predetermined voltage Vs1 (Vw1) is applied to the gate terminal of the MOSFET 13A (13B), the switch is turned on to cause a drain-source current to flow, thereby applying the potential V1 to the column wiring line.

Since the MOSFETs 13A and 13B are connected in parallel, a current is caused to flow into the column wiring line when one of the two switches is turned on. However, the amount of current (or potential) does not change instantaneously, and a certain transition time is required for the potential at the column wiring to reach V1. This transition time is influenced by characteristics of the MOSFET including the ON resistance, as described below.

On the other hand, the output section 14 connected to the constant voltage supply V0 is constituted of two switching devices. A transistor can be suitably used as each switching device. In this embodiment, an n-channel MOSFET (MOS-type field effect transistor), for example, is used.

MOSFETs differing in ON resistance from each other are selected as two MOSFETs 14C and 14D. More specifically, if the ON resistance of the MOSFET 14C is R14C and the ON resistance of the MOSFET 14D is R14D, the resistance values are selected so as to satisfy a relationship:

R14C<R14D.

The two MOSFETs 14C and 14D are connected in parallel with each other. The voltage from the constant voltage supply V0 is supplied to a source terminal of each MOSFET. A drain terminal of each MOSFET is connected to a column wiring terminal "OUT". Back gate terminals of the two MOSFETs 14C and 14D are connected to the lowest potential in the circuit. A gate terminal of the MOSFET 14C is connected to a control power supply 12 (voltage Vs0), and a gate terminal of the MOSFET 14C is connected to the control power supply 12 (voltage Vw0).

That is, when a predetermined voltage Vs0 (Vw0) is applied to the gate terminal of the MOSFET 14C (14D), the switch is turned on to cause a drain-source current to flow, thereby applying the potential V0 to the column wiring line.

Since the MOSFETs 14C and 14D are connected in parallel, a current is caused to flow into the column wiring line when one of the two switches is turned on. However, the current (or potential) value does not change instantaneously, and a certain transition time is required to increase the potential at the column wiring to V0. This transition time is influenced by characteristics of the MOSFET including the ON resistance and the like.

The waveform of the output from the output circuit will next be described with reference to FIG. 2.

Figure 2:
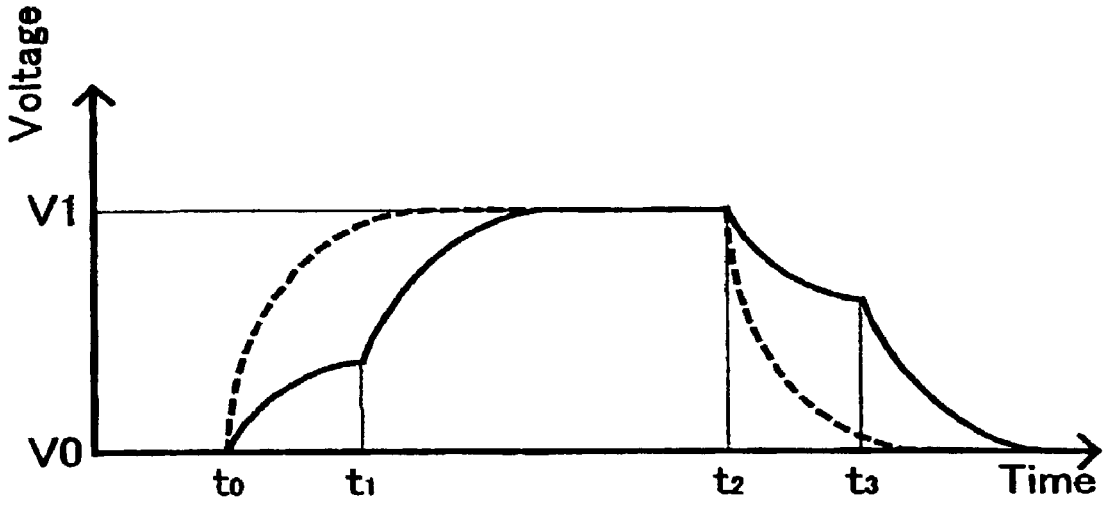
FIG. 2 is a diagram showing an example of an output waveform from an output circuit in the modulation circuit according to the first embodiment of the present invention.

FIG. 2 shows the waveform of the output from the output circuit, i.e., the potential waveform of the modulation signal applied from the modulation circuit. The solid line in FIG. 2 indicates the output waveform in accordance with this embodiment, and the dotted line indicates the output waveform in an example of the conventional art. The waveforms are shown by ignoring the voltage drop due to the ON resistance, since this voltage drop is sufficiently small.

The operation when a transition from potential V0 to potential V1 of the potential of the modulation signal is made will first be described.

In an initial state, each of the MOSFETs 13A and 13B in the output section 13 is off, each of the MOSFETs 14C and 14D in the output section 14 is on, and potential V0 is output from the constant voltage supply V0.

To make a transition from V0 to V1, the MOSFETs 14C and 14D in the output section 14 are turned off, one of the MOSFETs in the output section 13 having the higher ON resistance in the initial state, i.e., the MOSFET 13B, is then turned on, and the MOSFET 13A having the lower ON resistance, is finally turned on. These states of the MOSFETs are maintained when outputting V1 is continued.

If the ON resistance of a MOSFET is increased, the change in the amount of current flowing therethrough as drain-source current is reduced. That is, if a switching device having a larger ON resistance is used, the transition time from potential V0 to V1 is increased.

Therefore the switching devices are successively turned on from the one having the higher ON resistance as described above to effect a stepwise transition between the outputs from the constant voltage supplies to reach steady potential V1, as shown in FIG. 2.

Next, the operation when a transition from potential V1 to potential V0 of the potential of the modulation signal is made will be described.

To make a transition from V1 to V0, the MOSFETs 13A and 13B in the output section 13 are turned off, one of the MOSFETs in the output section 14 having the higher ON resistance, i.e., the MOSFET 14D, is turned on, and then the MOSFET 14C having the lower ON resistance, is finally turned on at the time of t3.

In this case, as is the case where a transition from V0 to V1 is made, the switching devices are successively turned on from the one having the higher ON resistance to effect a stepwise transition between the outputs from the constant voltage supplies to steady potential V0.

In the modulation circuit, the on-off timing of each switching device is controlled according to an input image signal to change the pulse width of the modulation signal, thus controlling the amount of electrons emitted from electron-emitting devices, i.e., the brightness of a displayed image.

A main cause of occurrence of "undesirable spike noise" described as a problem of the conventional art is a current caused to flow abruptly through the column wiring at the time of voltage switching.

In this embodiment, driving with the MOSFET having the higher ON resistance is performed during the time period in which such an abruptly-changing current flows, thereby limiting the current, and driving with the MOSFET having the lower ON resistance is performed after the certain time period, thereby limiting an abruptly-changing current in the wiring. Occurrences of electrical noise are thereby reduced.

In this manner, application of a voltage exceeding a rated limit to the electron-emitting device or the drive circuit is prevented, thus avoiding degradation in characteristics or breakdown of the electron-emitting device, a breakdown of the drive circuit due to latch-up, electromagnetic radiation to the outside of the display apparatus, etc. Thus, the reliability and the display performance of the image display apparatus are improved and the life of the image display apparatus is extended.

The ON resistance of the switching device operated during the time period when an abruptly-changing current flows is set higher than twice the resistance value during the subsequent period (more preferably, at least 2.1 times higher) thereby suitably reducing undesirable variation in potential.

The ON resistance of one of the two switching devices connected in parallel is set higher than that of the other switching device, the switching device having the higher ON resistance is first turned on (while the switching device having the lower ON resistance is off), and the switching device having the lower ON resistance is turned on while the switching device having the higher ON resistance is maintained in the on state, thus setting the resistance value in the former state higher than twice the resistance value in the state where both the switching devices connected in parallel are on at a time.

(Second Embodiment)

Figure 3:
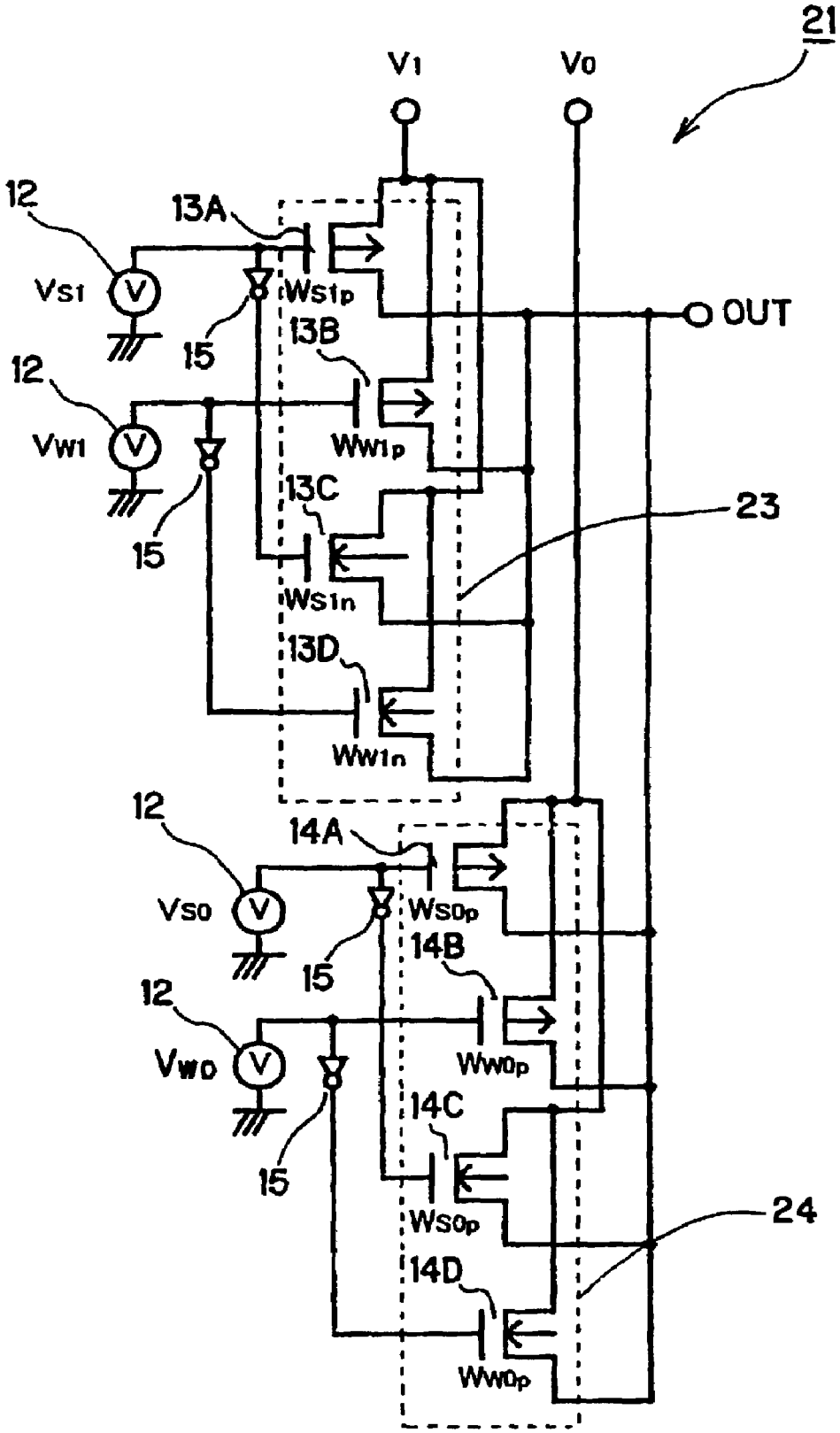
FIG. 3 is a circuit diagram schematically showing the configuration of a main portion of a modulation circuit according to a second embodiment of the present invention.

FIG. 3 shows the second embodiment of the present invention.

In this embodiment, n-channel transistors and p-channel transistors used as switching devices are connected in parallel with each other.

In other respects, the configuration and functions of this embodiment are approximately the same as those of the first embodiment. Components of this embodiment corresponding to those of the first embodiment are indicated by the same reference characters, and the description for them will not be repeated. This embodiment will be described mainly with respect to points of difference from the first embodiment.

FIG. 3 is a circuit diagram schematically showing the configuration of a main portion of a modulation circuit provided in an image display apparatus of this embodiment.

An output circuit 21 shown in FIG. 3 controls outputs from a plurality of constant voltage supplies V1 and V0 according to an input image signal to obtain a modulation signal and outputs the modulation signal to a column wiring line. The output circuit 21 has an output section 23 formed as a switching means for on/off control of the output from the constant voltage supply V1, and an output section 24 formed as a switching means for on/off control of the output from the constant voltage supply V0.

The output section 23 connected to the constant voltage supply V1 is constituted of four switching devices. A transistor can be suitably used as each switching device. In this embodiment, p-channel MOSFETs 13A and 13B and n-channel MOSFETs 13C and 13D are used in combination.

MOSFETs differing in ON resistance from each other are selected as two p-channel MOSFETs 13A and 13B. Also, MOSFETs differing in ON resistance from each other are selected as two n-channel MOSFETs 13C and 13D.

More specifically, if the ON resistances of the MOSFETs 13A, 13B, 13C, and 13D are R13A, R13B, R13C, and R13D, respectively, the resistance values are selected so as to satisfy relationships:

R13A<R13B and

R13C<R13D.

The four MOSFETs 13A, 13B, 13C, and 13D are connected in parallel with each other. The voltage from the constant voltage supply V1 is supplied to a source terminal of each MOSFET. A drain terminal of each MOSFET is connected to a column wiring terminal "OUT".

Back gate terminals of the two p-channel MOSFETs 13A and 13B are connected to the highest potential in the circuit, while back gate terminals of the two n-channel MOSFETs 13C and 13D are connected to the lowest potential in the circuit.

The p-channel MOSFET 13A and the n-channel MOSFET 13C are connected in common to a control power supply 12 (voltage Vs1) while being connected in parallel with each other. However, while a gate terminal of the MOSFET 13A is directly connected to the control power supply 12, a gate terminal of the MOSFET 13C is connected to the control power supply 12 via an inverter 15 for inverting the voltage level of the control power supply 12.

The p-channel MOSFET 13B and the n-channel MOSFET 13D are connected in common to the control power supply 12 (voltage Vw1) while being connected in parallel with each other. However, a gate terminal of the n-channel MOSFET 13D is connected to the control power supply via an inverter 15, as is that of the MOSFET 13C.

The output section 24 connected to the constant voltage supply V0 is also constituted of four switching devices. A transistor can be suitably used as each switching device. In this embodiment, p-channel MOSFETs 14A and 14B and n-channel MOSFETs 14C and 14D are used in combination.

MOSFETs differing in ON resistance from each other are selected as two p-channel MOSFETs 14A and 14B. Also, MOSFETs differing in ON resistance from each other are selected as two n-channel MOSFETs 14C and 14D.

More specifically, if the ON resistances of the MOSFETs 14A, 14B, 14C, and 14D are R14A, R14B, R14C, and R14D, respectively, the resistance values are selected so as to satisfy relationships:

R14A<R14B and

R14C<R14D.

The four MOSFETs 14A, 14B, 14C, and 14D are connected in parallel with each other. The voltage from the constant voltage supply V0 is supplied to a source terminal of each MOSFET. A drain terminal of each MOSFET is connected to a column wiring terminal "OUT".

Back gate terminals of the two p-channel MOSFETs 14A and 14B are connected to the highest potential in the circuit, while back gate terminals of the two n-channel MOSFETs 14C and 14D are connected to the lowest potential in the circuit.

The p-channel MOSFET 14A and the n-channel MOSFET 14C are connected in common to a control power supply 12 (voltage Vs0) while being connected in parallel with each other. However, while a gate terminal of the MOSFET 14A is directly connected to the control power supply 12, a gate terminal of the MOSFET 14C is connected to the control power supply 12 via an inverter 15 for inverting the voltage level of the control power supply 12.

The p-channel MOSFET 14B and the n-channel MOSFET 14D are connected in common to the control power supply 12 (voltage Vw0) while being connected in parallel with each other. However, a gate terminal of the n-channel MOSFET 14D is connected to the control power supply via an inverter 15, as is that of the MOSFET 14C.

In the above-described arrangement, when the potential of the modulation signal is changed, the switching devices are successively turned on from the one having the higher ON resistance to effect a stepwise transition between the outputs of the constant voltage supply to reach steady potential.

Thus, the arrangement of this embodiment also has the same effect as that of the first embodiment.

Further, in this embodiment, p-channel and n-channel transistors are used in combination so that a change in the ON resistance of each MOSFET due to the back gate effect can be canceled out, thereby enabling more strict gradation control.

(Third Embodiment)

Figure 4:
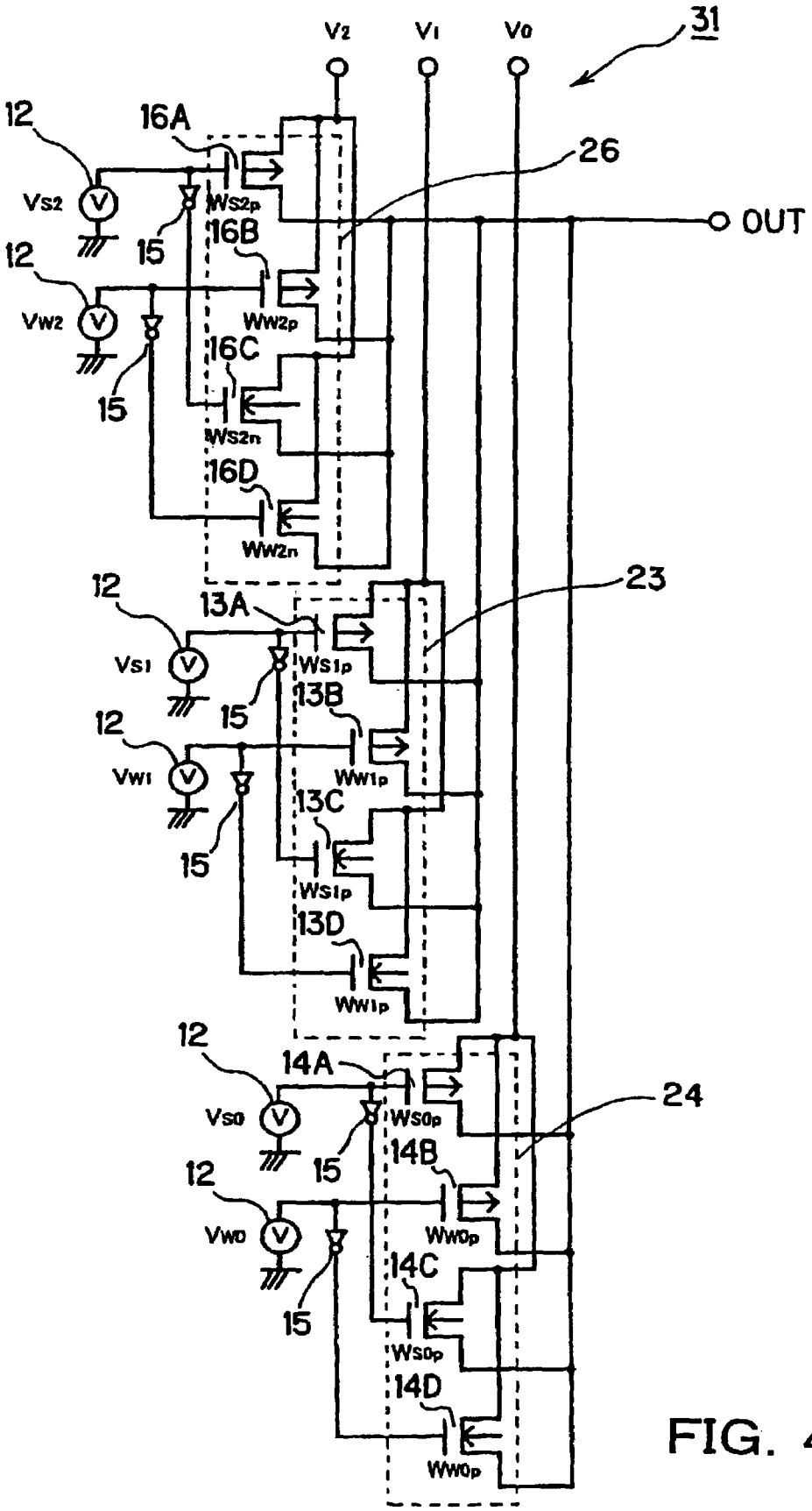
FIG. 4 is a circuit diagram schematically showing the configuration of a main portion of a modulation circuit according to a third embodiment of the present invention.

FIG. 4 shows the third embodiment of the present invention.

While two voltage levels V0 and V1 are set in the first and second embodiments, the third embodiment will be described with respect to a circuit configuration in which three voltage levels are set.

In other respects, the configuration and functions of the third embodiment are the same as those of the above-described embodiments. Components of this embodiment corresponding to those of the above-described embodiments are indicated by the same reference characters, and the description for them will not be repeated. This embodiment will be described mainly with respect to points of difference from the above-described embodiments.

FIG. 4 is a circuit diagram schematically showing the configuration of a main portion of a modulation circuit provided in an image display apparatus of this embodiment.

An output circuit 31 shown in FIG. 4 controls outputs from a plurality of constant voltage supplies V2, V1 and V0 according to an input image signal to obtain a modulation signal and outputs the modulation signal to a column wiring line. The output circuit 31 has an output section 26 formed as a switching means for on/off control of the output from the constant voltage supply V2, an output section 23 formed as a switching means for on/off control of the output from the constant voltage supply V1, and an output section 24 formed as a switching means for on/off control of the output from the constant voltage supply V0.

The configuration and functions of the output sections 23 and 24 are the same as those of the corresponding sections in the above-described second embodiment, and the description for them will not be repeated.

The output section 26 connected to the constant voltage supply V2 is constituted of four switching devices. A transistor can be suitably used as each switching device. In this embodiment, p-channel MOSFETs 16A and 16B and n-channel MOSFETs 16C and 16D are used in combination.

MOSFETs differing in ON resistance from each other are selected as two p-channel MOSFETs 16A and 16B. Also, MOSFETs differing in ON resistance from each other are selected as two n-channel MOSFETs 16C and 16D.

More specifically, if the ON resistances of the MOSFETs 16A, 16B, 16C, and 16D are R16A, R16B, R16C, and R16D, respectively, the resistance values are selected so as to satisfy relationships:

R16A<R16B and

R16C<R16D.

The four MOSFETs 16A, 16B, 16C, and 16D are connected in parallel with each other. The voltage from the constant voltage supply V2 is supplied to a source terminal of each MOSFET. A drain terminal of each MOSFET is connected to a column wiring terminal "OUT".

Back gate terminals of the two p-channel MOSFETs 16A and 16B are connected to the highest potential in the circuit, while back gate terminals of the two n-channel MOSFETs 16C and 16D are connected to the lowest potential in the circuit.

The p-channel MOSFET 16A and the n-channel MOSFET 16C are connected in common to a control power supply 12 (voltage Vs2) while being connected in parallel with each other. However, while a gate terminal of the MOSFET 16A is directly connected to the control power supply 12, a gate terminal of the MOSFET 16C is connected to the control power supply 12 via an inverter 15 for inverting the voltage level of the control power supply 12.

The p-channel MOSFET 16B and the n-channel MOSFET 16D are connected in common to the control power supply 12 (voltage Vw2) while being connected in parallel with each other. However, a gate terminal of the n-channel MOSFET 16D is connected to the control power supply via an inverter 15, as is that of the MOSFET 16C.

Figure 5:
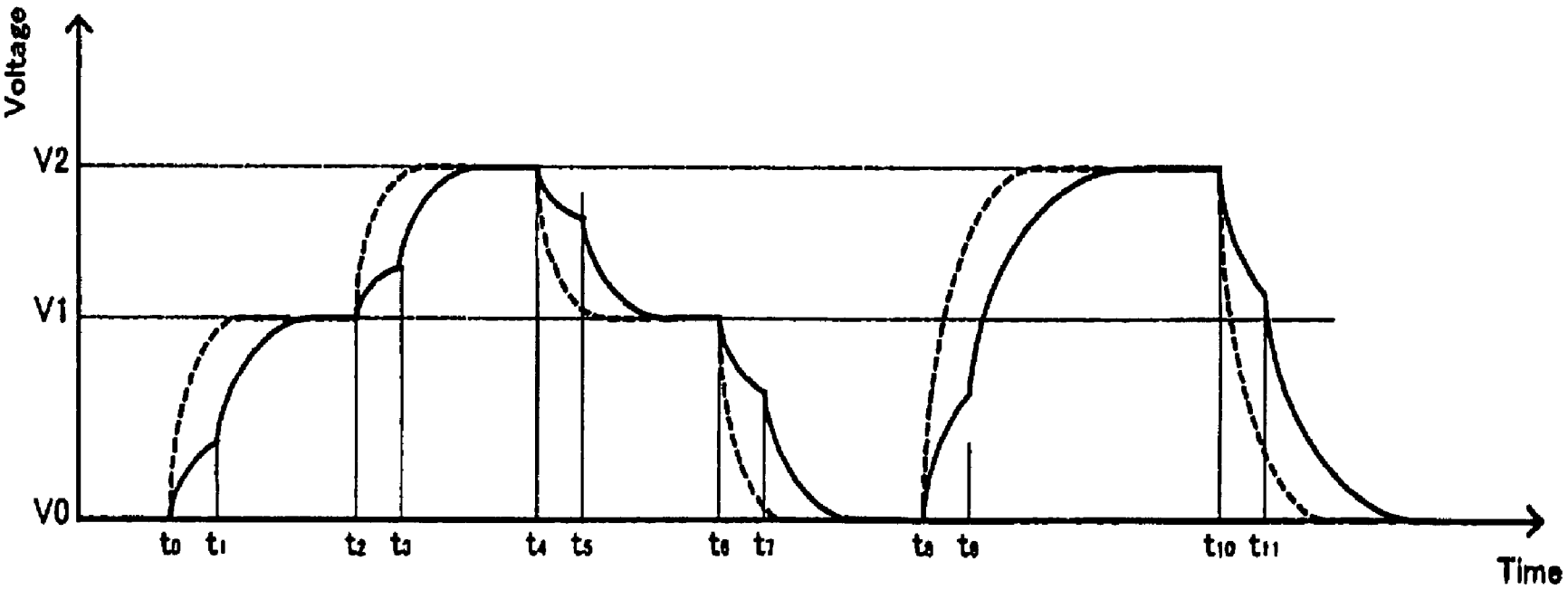
FIG. 5 is a diagram showing an example of an output waveform from an output circuit in the modulation circuit according to the third embodiment of the present invention.

FIG. 5 shows the waveform of the output from the output circuit, i.e., the potential waveform of the modulation signal applied from the modulation circuit. The solid line in FIG. 5 indicates the output waveform in accordance with this embodiment, and the dotted line indicates the output waveform in an example of the conventional art.

In the output waveform on the left-hand side of FIG. 5, the potential of the modulation signal is changed as shown by V0→V1→V2→V1→V0. In the output waveform on the right-hand side of FIG. 5, the potential of the modulation signal is changed as shown by V0→V2→V0. In either case, the switching devices in each of the output sections 23, 24, and 26 are successively turned on from the one having the higher ON resistance to effect a stepwise transition between the outputs from the constant voltage supplies to reach the steady potential.

Thus, even in a case where the number of voltage levels are increased as in this embodiment, the switch means in accordance with the present invention is used in each of the output section connected to the constant voltage supplies to achieve the same effect as that in the above-described embodiments. Needless to say, the switch means of the present invention can also be used even in a case where the number of voltage levels is four or greater.

Also in this embodiment, p-channel and n-channel transistors are used in combination, so that a change in the ON resistance of each MOSFET due to the back gate effect can be canceled out, thereby enabling more strict gradation control.

In a case where the number of voltage levels is three or greater as in this embodiment, the on-off timing of each switching device is controlled in the modulation circuit according to an input image signal to change the pulse width and amplitude of the modulation signal, thus controlling the amount of electrons emitted from electron-emitting devices, i.e., the brightness of a displayed image.

(Fourth Embodiment)

Figure 6:
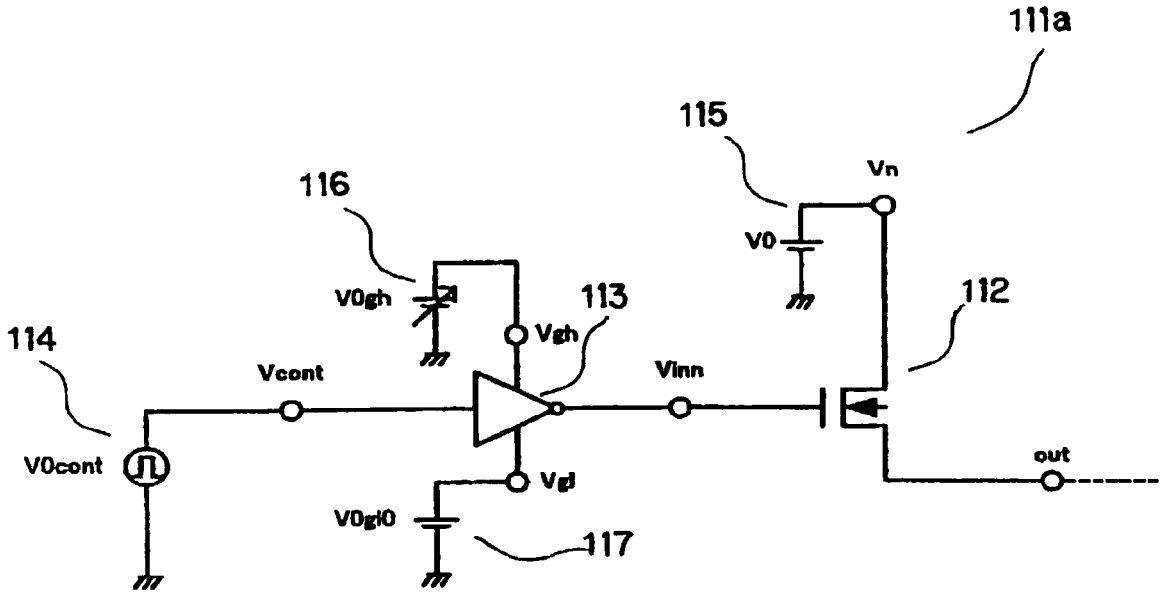
FIG. 6 is a block diagram schematically showing the configuration of a modulation device according to a fourth embodiment of the present invention.

FIG. 6 shows the configuration of a modulation device 111*a* of the fourth embodiment of the present invention.

The modulation device 111*a* has, as its essential components, a final output section 112, a prestage output section 113, a control signal generation section 114, a voltage supply (modulation signal power supply) 115 for supplying a modulation signal voltage, a voltage supply (variable power supply) 116 for supplying a high-level voltage, which is output from the prestage output section 113 to the final output section 112, and a voltage supply (constant power supply) 117 for supplying a low-level voltage, which is output from the prestage output section 113 to the final output section 112.

The final output section 112 is constituted of a MOSFET or the like. The final output section 112 has a source terminal Vn to which the power supply 115 is connected, a drain terminal "out" to which a column electrode is connected, and a gate terminal Vinn to which an output from the prestage output section 113 is input.

The prestage output section 113 is a prestage of the final output section 112 and has a high-level voltage terminal Vgh to which the variable power supply 116 is connected, a low-level voltage terminal Vgl to which the power supply 117 is connected, and a control terminal Vcont for control of the operation of the prestage output section 113, to which a signal output from the control signal generation section 114 is supplied.

This embodiment is characterized in that the level of a high-level voltage output from the prestage output section 113 is variable through control of a voltage value V0gh of the voltage supply 116, and the ON resistance of the final output section 112 can be changed by changing the level of the high-level voltage output from the prestage output section 113.

The operation principle and the effects of the fourth embodiment of the present invention will be described with reference to FIGS. 7 and 8.

Figure 7:
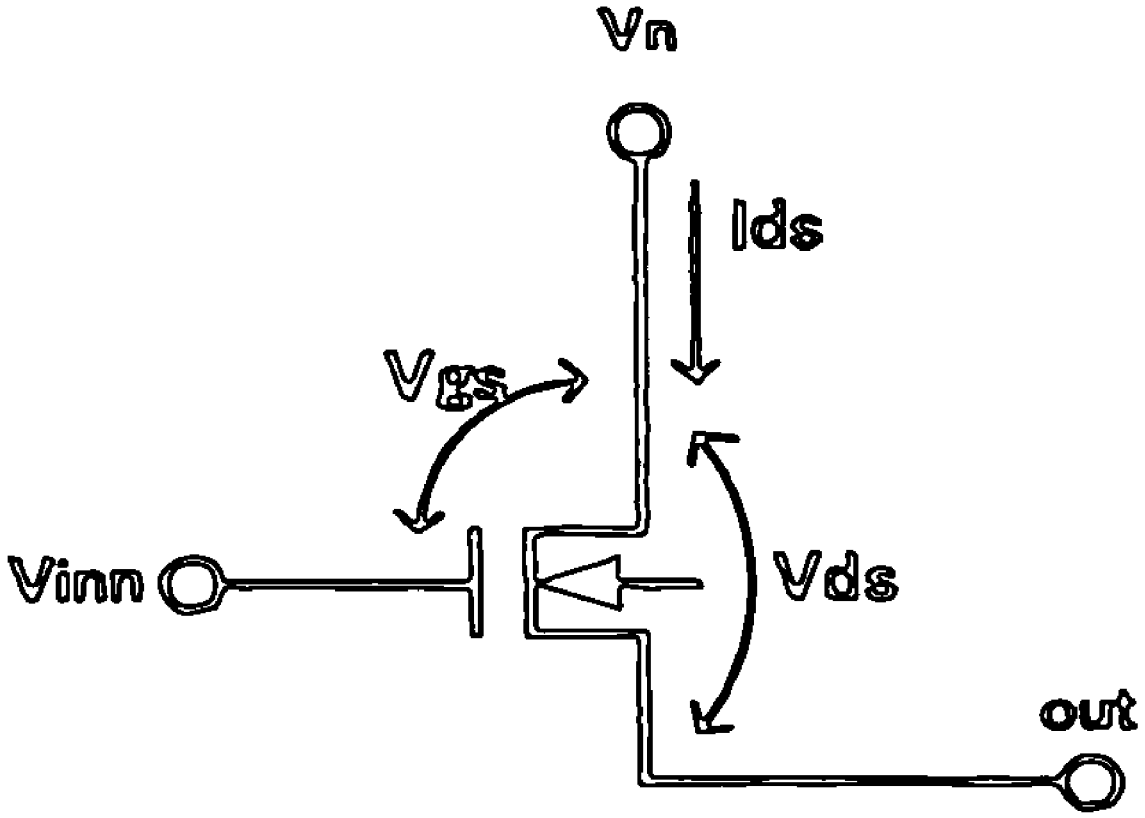
FIG. 7 PRIOR ART
FIG. 7 is a diagram for explaining the operation of a MOSFET.

FIG. 7 shows the MOSFET in the final output section described in the first embodiment of the present invention.

Figure 8:
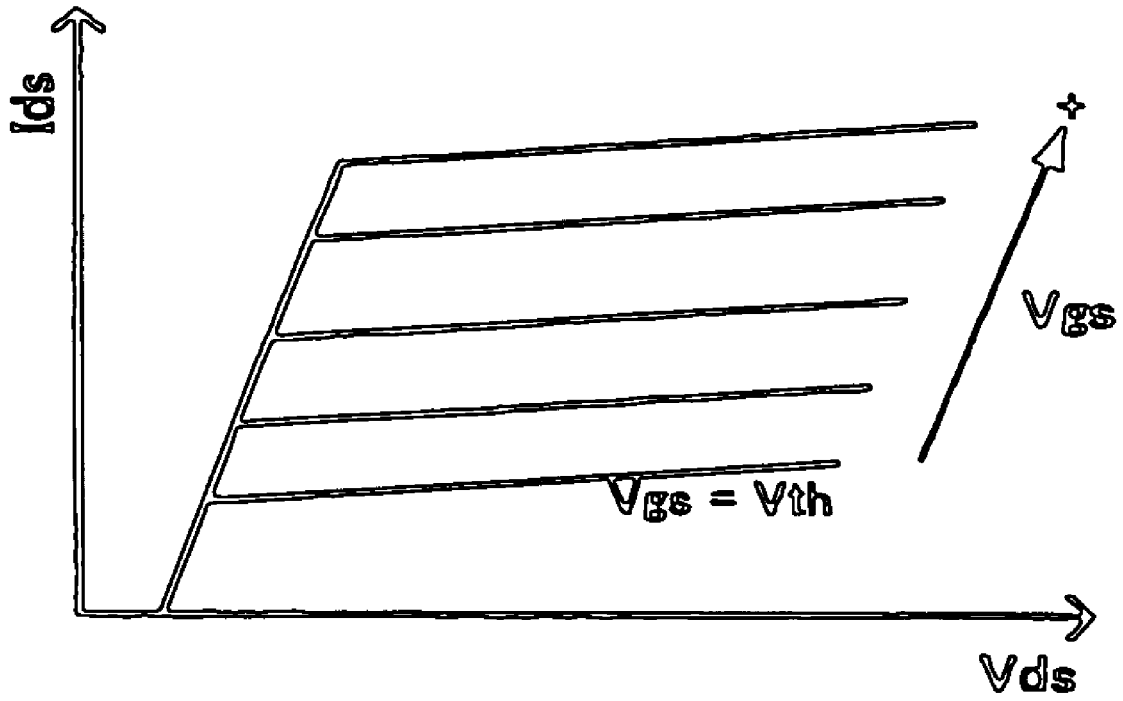
FIG. 8 PRIOR ART
FIG. 8 is a diagram showing I-V characteristics of the MOSFET.

FIG. 8 shows the relationship between the drain-source current (Ids) and the gate-source voltage with respect to the drain-source voltage (Vds) of a MOSFET.

An n-channel MOSFET is in the off state when the gate voltage Vgs is lower than the threshold voltage Vth (low level), and is in the on state when the gate voltage is higher than Vth (high level). As Vgs becomes higher, Ids increases, as can be understood from FIG. 8. This means that the ON resistance of the MOSFET becomes lower when the gate voltage is increased, and that the ON resistance of the MOSFET becomes higher when the gate voltage is reduced.

Figure 9:
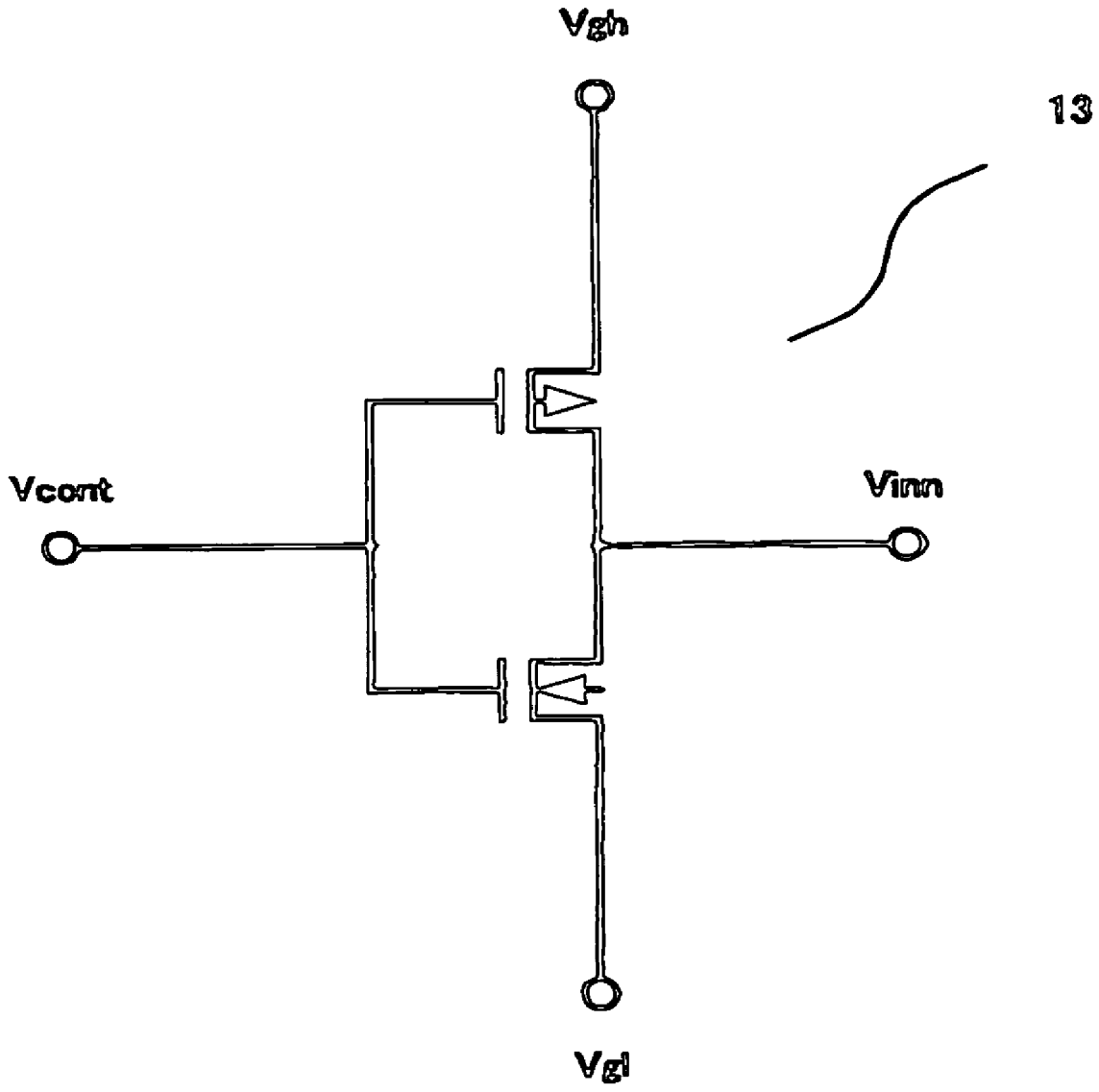
FIG. 9 PRIOR ART
FIG. 9 is a diagram showing an inverter constituting a prestage output section.

In this embodiment, it is characterized in that this characteristic is utilized in such a manner that the level of voltage applied to the gate terminal of the MOSFET in the final output section is controlled through the prestage output section to change the ON resistance of the modulation circuit. Therefore, the prestage output section may be realized in such a configuration that the output voltage can be changed according to the voltage value of the power supply voltage, e.g., an inverter configuration such as that shown in FIG. 9.

The configuration of the prestage output section is not limited to this. Any other circuit configuration may suffice if the above-described condition is satisfied, that is, the output voltage can be changed according to the voltage value of the power supply voltage.

The effects of this embodiment will be described with reference to FIGS. 10A and 10B.

Figure 10A:
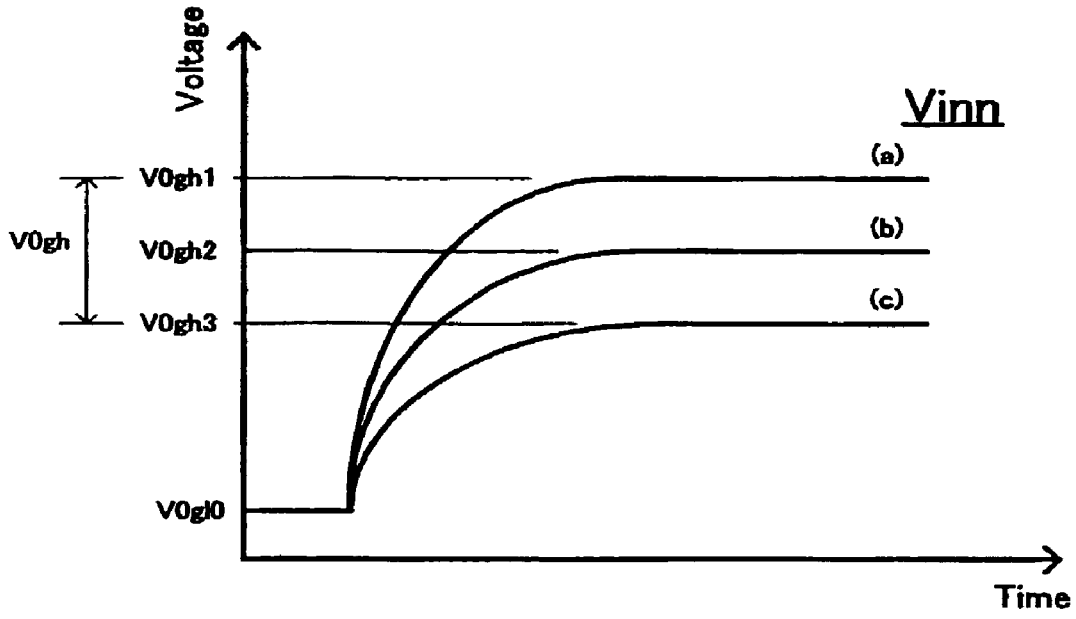
FIG. 10A is a diagram showing a voltage waveform at terminal Vinn in the fourth embodiment.
Figure 10B:
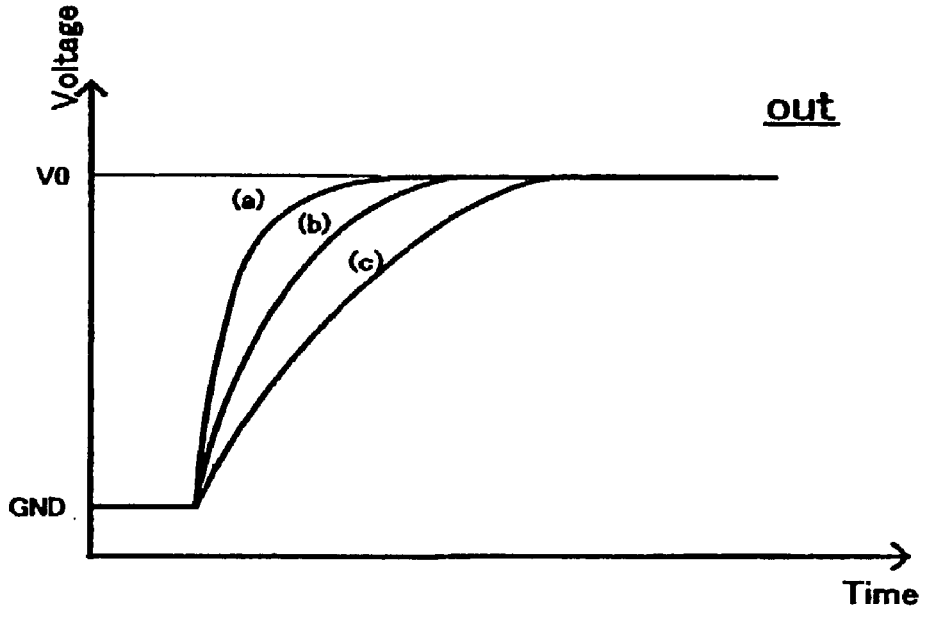
FIG. 10B is a diagram showing a voltage waveform at the terminal OUT in the fourth embodiment.

FIGS. 10A and 10B show voltage waveforms at the terminal Vinn and the terminal "out" when the voltage of the power supply 116 is changed. In this embodiment, the voltage drop due to the ON resistance is ignored since it is sufficiently small.

GND potential is output to the terminal "out" by the final output section (not shown). A transition from GND potential to voltage V0 will be described by way of example.

The voltage of the power supply 116 is set to V0gh1 and a control signal for outputting low level to high level is input from the control signal generation section 114 to the prestage output section 113. A voltage waveform output to the terminal Vinn at this time is as indicated at (a) in FIG. 10A. When this voltage waveform is input to the gate terminal of the MOSFET in the final output section, a voltage waveform shown at (a) in FIG. 10B is output to the terminal "out".

A voltage waveform when the voltage of the power supply 116 is set to V0gh2 will next be described.

A control signal for outputting low level to high level is input from the control signal generation section 114 to the prestage output section 113. A voltage waveform output to the terminal Vinn at this time is as indicated at (b) in FIG. 10A. When this voltage waveform is input to the gate terminal of the MOSFET in the final output section, a voltage waveform shown at (b) in FIG. 10B is output to the terminal "out". That is, when the voltage value input to the MOSFET is lowered from V0gh1 to V0gh2, Vgs applied to the MOSFET is reduced and the ON resistance of the MOSFET is increased. The resulting voltage waveform output to the terminal "out" is such that the voltage rises at a reduced rate.

A voltage waveform when the voltage of the power supply 116 is set to V0gh3 will next be described.

A control signal for outputting low level to high level is supplied from the control signal generation section 114 to the prestage output section 113. A voltage waveform output to the terminal Vinn at this time is as indicated at (c) in FIG. 10A. When this voltage waveform is input to the gate terminal of the MOSFET in the final output section, a voltage waveform shown at (c) in FIG. 10B is output to the terminal "out". That is, when the voltage value input to the MOSFET is lowered to V0gh3, Vgs applied to the MOSFET is further reduced and the ON resistance of the MOSFET is increased. The resulting voltage waveform output to the terminal "out" is such that the voltage rises at a further reduced rate.

In this embodiment, as can be understood from the above, the ON resistance of the modulation circuit can be changed by changing the power supply voltage even when the drive load varies. Thus, the driving ability of the modulation circuit can always be optimized to solve the above-described problems.

(Fifth Embodiment)

Figure 11:
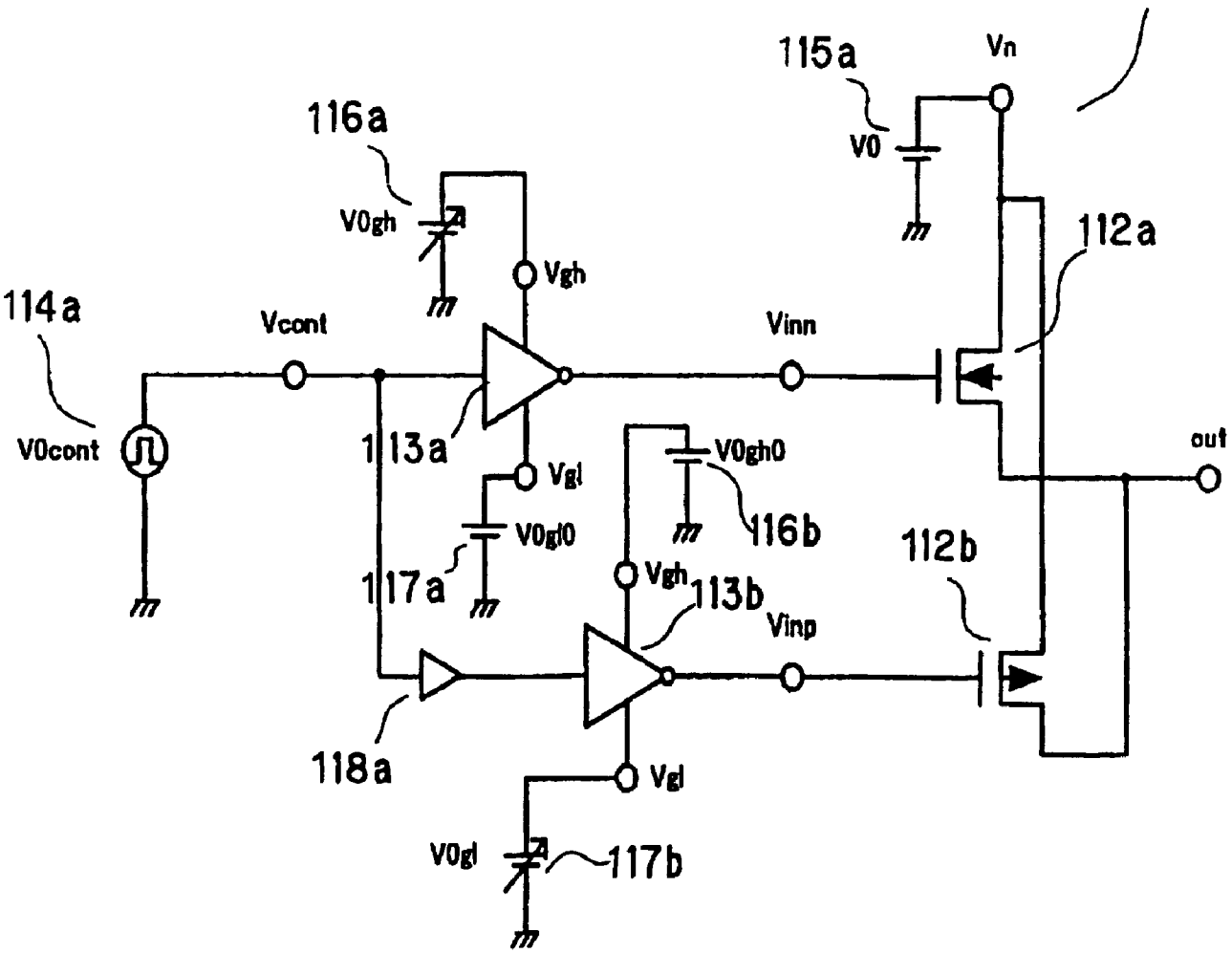
FIG. 11 is a block diagram schematically showing the configuration of a modulation device according to a fifth embodiment of the present invention.

FIG. 11 shows the fifth embodiment of the present invention.

A modulation device 111*b* of this embodiment has final output sections 112*a* and 112*b*, prestage output sections 113*a* and 113*b*, a control signal generation section 114*a*, a voltage supply (modulation signal power supply) 115*a* for supplying a modulation signal voltage, a voltage supply (first variable power supply) 116*a* for supplying a high-level voltage which is output from the prestage output section 113*a*, a voltage supply (second constant power supply) 116*b* for supplying a high-level voltage which is output from the prestage output section 113*b*, a voltage supply (first constant power supply) 117*a* for supplying a low-level voltage which is output from the prestage output section 113*a*, a voltage supply (second variable power supply) 117*b* for supplying a low-level voltage which is output from the prestage output section 113*b*, and an inverter (control signal inverting circuit) 118*a* which inverts a control signal.

This embodiment differs from the fourth embodiment in that the final output sections for outputting voltage V0 are constituted of a p-channel MOSFET and an n-channel MOSFET connected in parallel with each other, and that the prestage output section 113*b* and the inverter 118*a* for operating the p-channel MOSFET are newly provided.

Further, power supplies for the terminals Vgh and Vgl of the prestage output sections 113*a* and 113*b* are separated, and especially, the power supply 116*a* and the power supply 117*b* are variable.

Furthermore, a control signal sent from the control signal generation section 114*a* is directly input to the prestage output section 113*a*, and is input to the prestage output section 113*b* after being inverted by the inverter 118*a*.

The effects of this embodiment will be described.

The effects on the n-channel side are the same as those in the fourth embodiment of the present invention and the description for them will not be repeated. The effects on the p-channel side will be described with reference to FIGS. 12A and 12B.

Figure 12A:
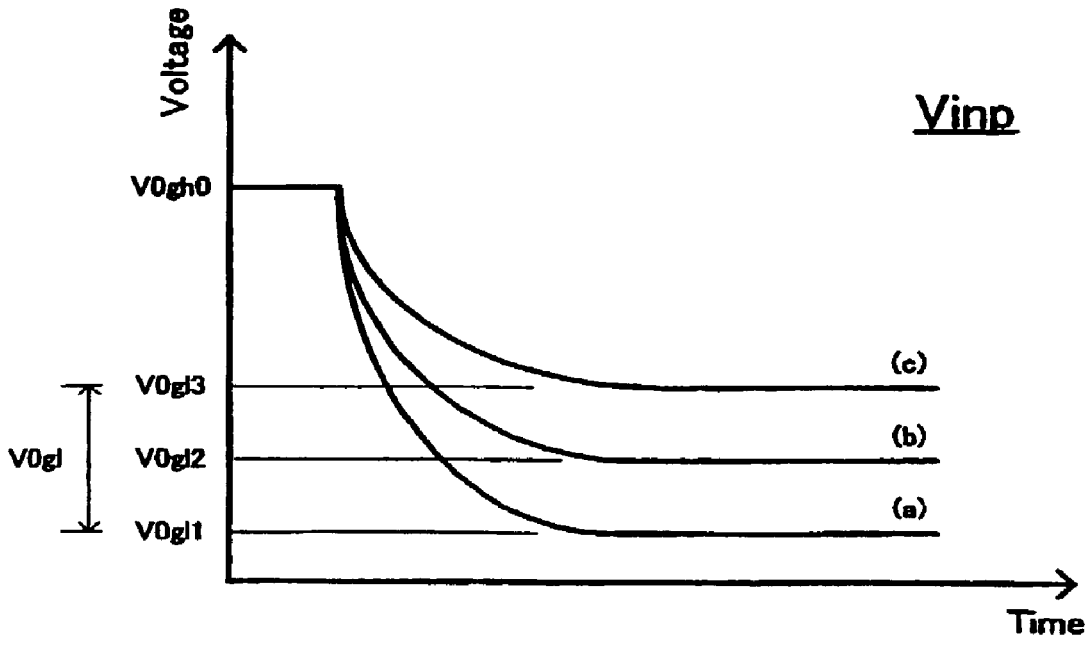
FIG. 12A is a diagram showing a voltage waveform at terminal Vinp in the fifth embodiment.
Figure 12B:
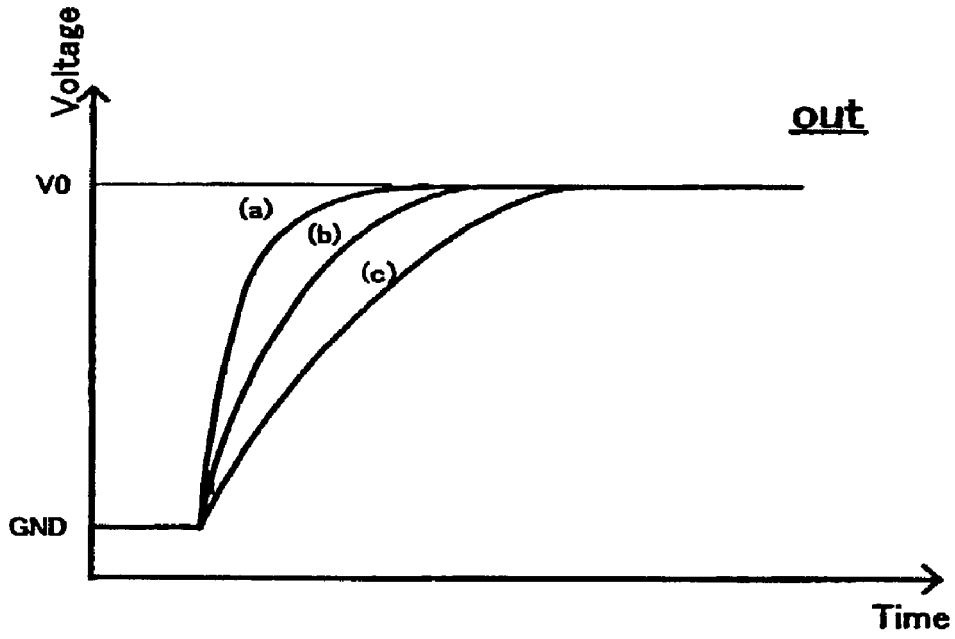
FIG. 12B is a diagram showing a voltage waveform at the terminal OUT in the fifth embodiment.

FIGS. 12A and 12B show voltage waveforms at a terminal Vinp and the terminal "out" when the voltage of the power supply 117*b* is changed.

GND potential is output to the terminal "out" by the final output section (not shown). A transition from GND potential to voltage V0 will be described by way of example.

The voltage of the power supply 117*b* is set to V0gh11 and a control signal for outputting high level to low level is input from the control signal generation section 114*a* to the prestage output section 113*b* via the inverter 118*a*. A voltage waveform output to the terminal Vinp at this time is as indicated at (a) in FIG. 12A. When this voltage waveform is input to the gate terminal of the MOSFET in the final output section, a voltage waveform shown at (a) in FIG. 12B is output to the terminal "out".

A voltage waveform when the voltage of the power supply 117*b* is set to V0g12 will next be described.

A control signal for outputting high level to low level is supplied from the control signal generation section 114*a* to the prestage output section 113*b* via the inverter 118*a*. A voltage waveform output to the terminal Vinp at this time is as indicated at (b) in FIG. 12A. When this voltage waveform is supplied to the gate terminal of the MOSFET in the final output section, a voltage waveform shown at (b) in FIG. 12B is output to the terminal "out". That is, when the voltage value input to the MOSFET is increased from V0g11 to V0g12, Vgs applied to the MOSFET is reduced and the ON resistance of the MOSFET is increased. The resulting voltage waveform output to the terminal "out" is such that the voltage rises at a reduced rate.

A voltage waveform when the voltage of the power supply 117*b* is set to V0g13 will next be described.

A control signal for outputting high level to low level is supplied from the control signal generation section 114*a* to the prestage output section 113*b* via the inverter 118*a*. A voltage waveform output to the terminal Vinp at this time is as indicated at (c) in FIG. 12A. When this voltage waveform is input to the gate terminal of the MOSFET in the final output section, a voltage waveform shown at (c) in FIG. 12B is output to the terminal "out". That is, when the voltage value input to the MOSFET is increased to V0g13, Vgs applied to the MOSFET is further reduced and the ON resistance of the MOSFET is increased. The resulting voltage waveform output to the terminal "out" is such that the voltage rises at a further reduced rate.

As can be understood from the above, if the present invention is implemented on the basis of this embodiment, the ON resistance of the modulation circuit can be changed by changing the power supply voltage even when the drive load varies. Thus, the driving ability of the modulation circuit can always be optimized to solve the above-described problems. Also, p-channel and n-channel transistors are used in combination in the output sections, so that a change in the ON resistance of each MOSFET due to the back gate effect can be canceled out, thereby enabling more strict gradation control.

(Sixth Embodiment)

Figure 13:
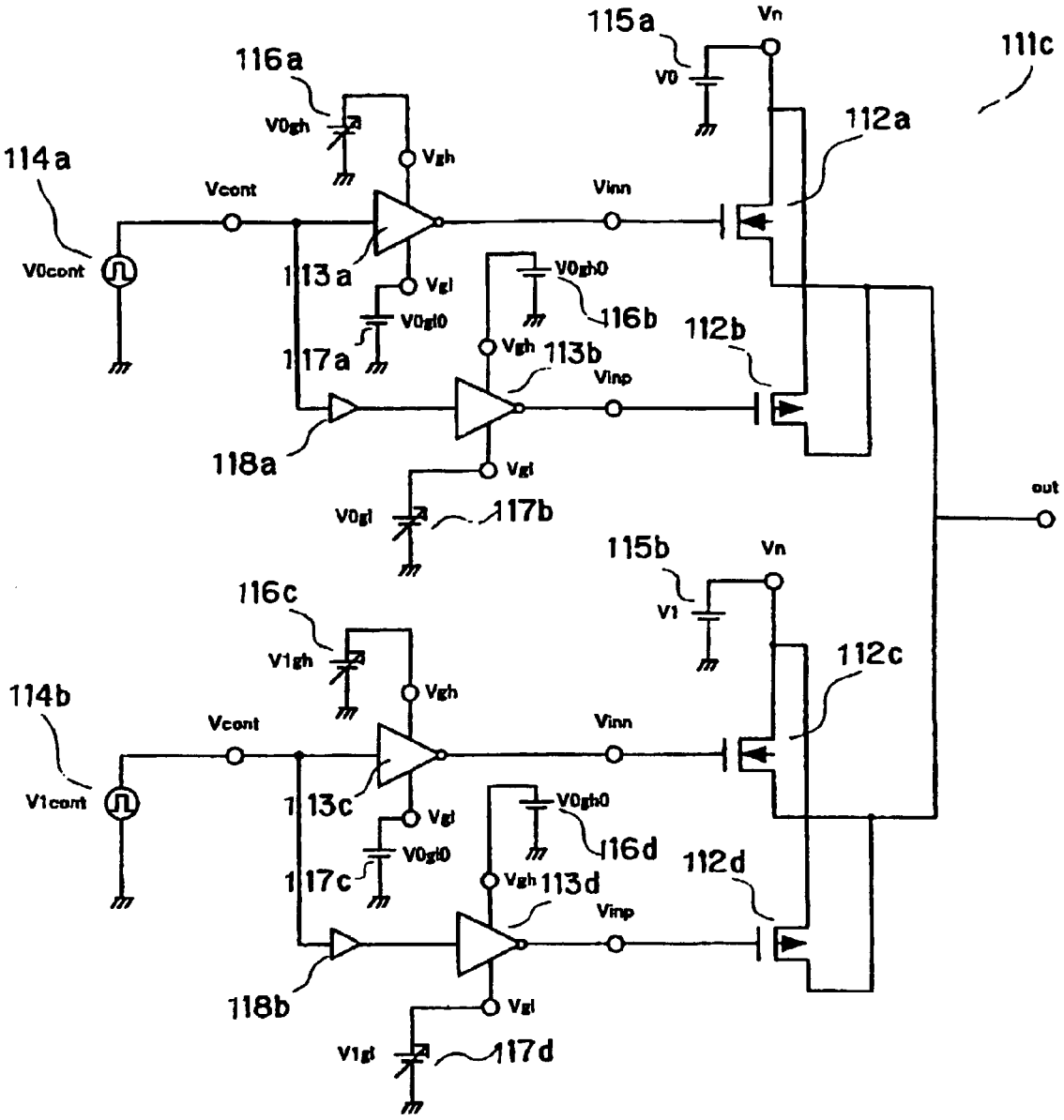
FIG. 13 is a block diagram schematically showing the configuration of a modulation device according to a sixth embodiment of the present invention.
Figure 14:
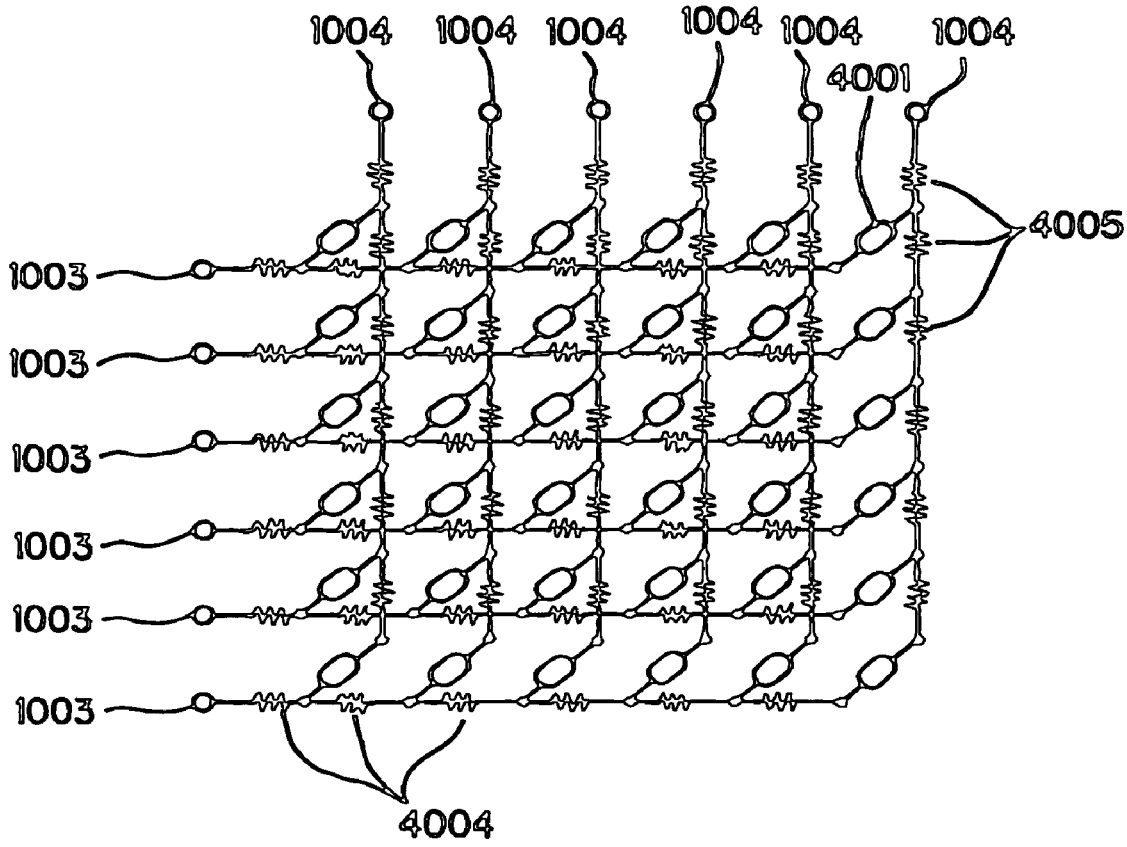
FIG. 14 PRIOR ART
FIG. 14 is a schematic diagram of a multi-beam electron source.
Figures 15A, 15B, 15C, 15D:
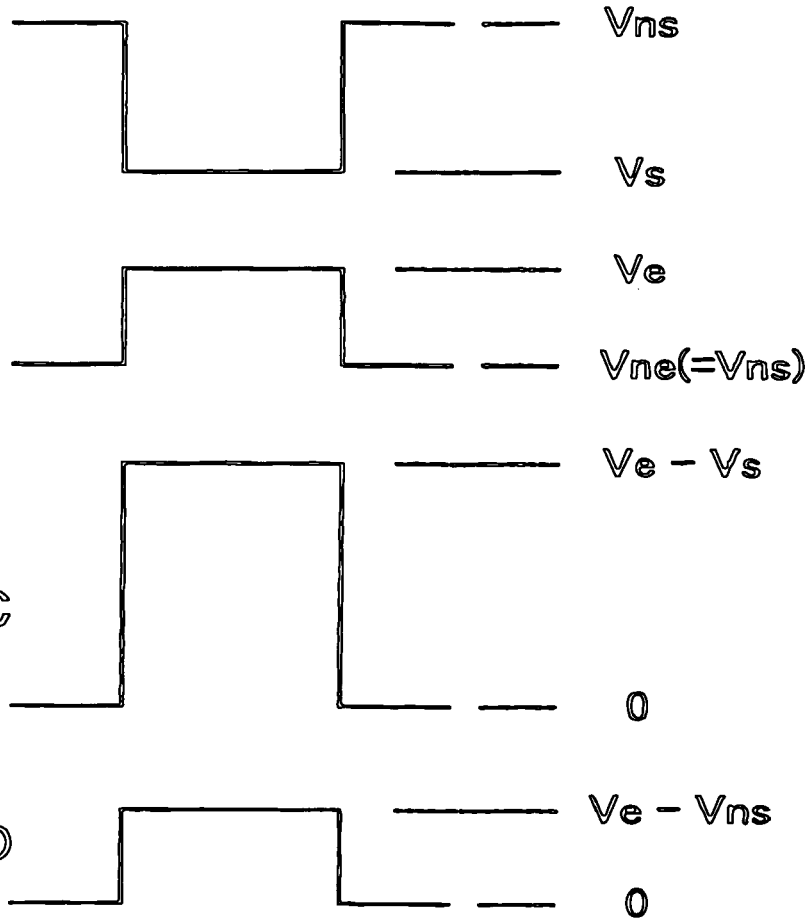
FIG. 15A PRIOR ART
FIG. 15B PRIOR ART
FIG. 15C PRIOR ART
FIG. 15D PRIOR ART
FIGS. 15A to 15D are diagrams showing examples of drive waveforms for driving a surface conduction electron-emitting device.
Figure 16:
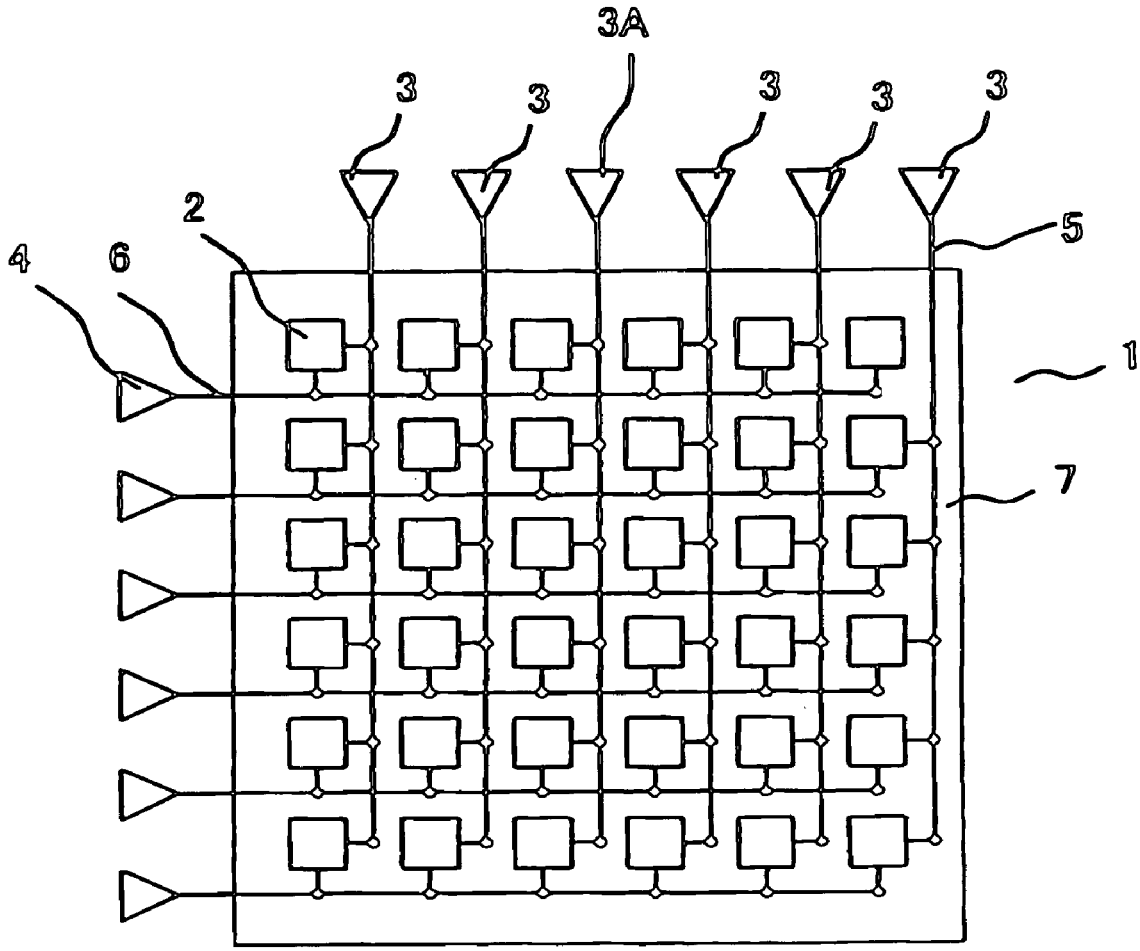
FIG. 16 PRIOR ART
FIG. 16 is a schematic plane view of the configuration of an image display apparatus in which surface conduction electron-emitting devices are wired by passive matrix wiring.
Figure 17:
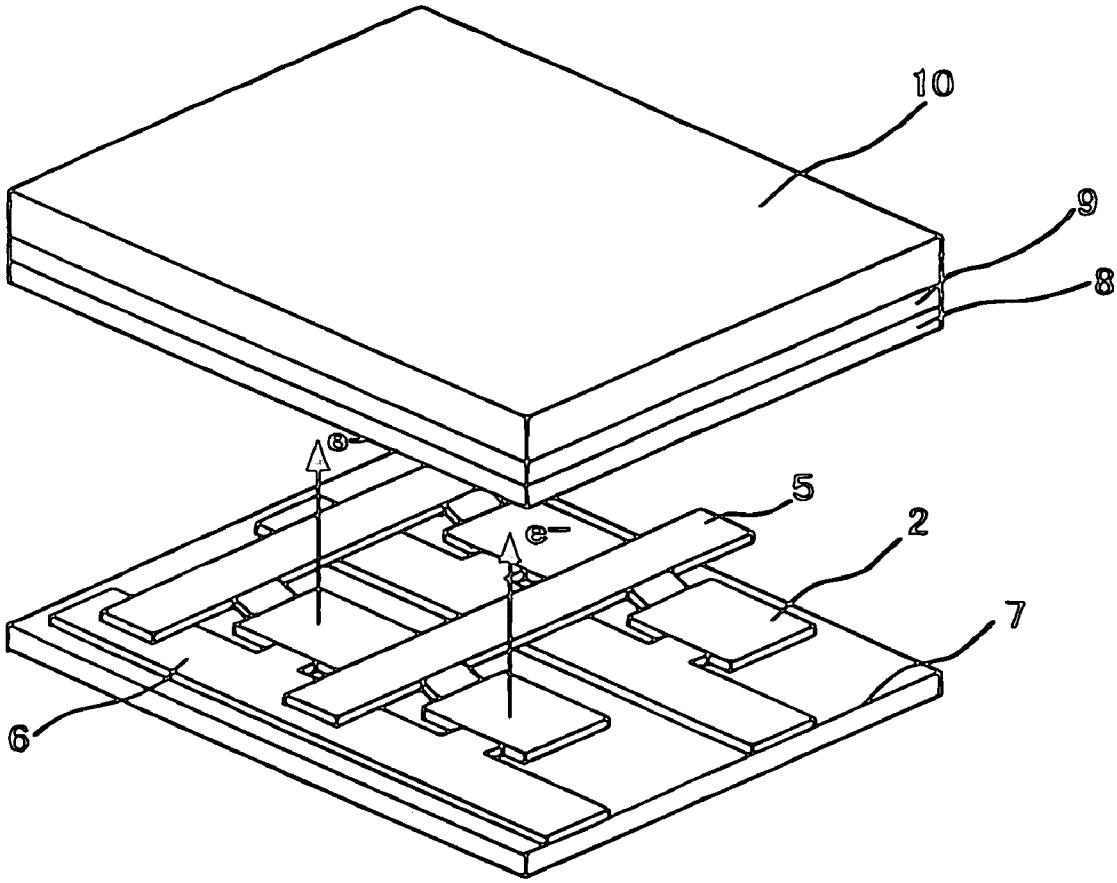
FIG. 17 PRIOR ART
FIG. 17 is a schematic perspective view of a main portion of an image display apparatus.
Figure 18:
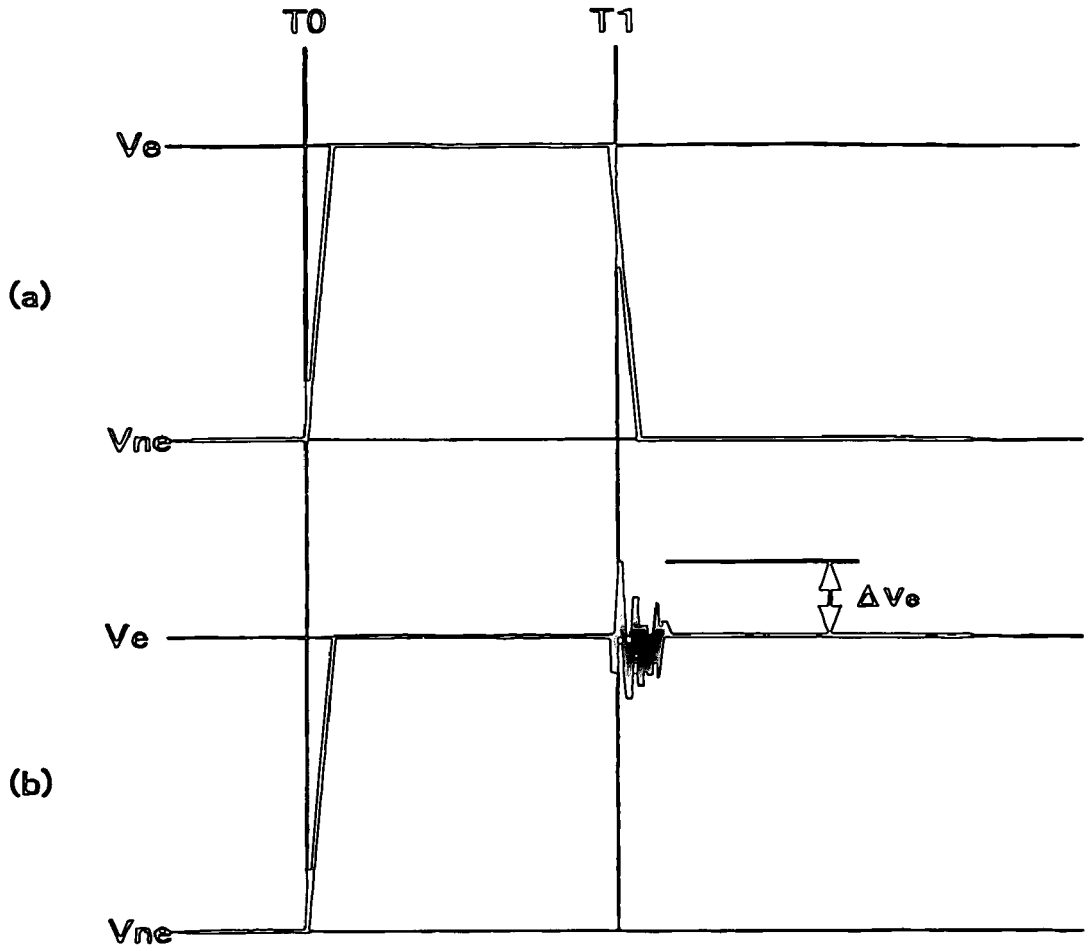
FIG. 18 PRIOR ART
FIG. 18 is a diagram for explaining electrical noise generated at the time of voltage switching.

FIG. 13 shows the configuration of a modulation device 111*c* of the sixth embodiment of the present invention.

The modulation device 111*c* has first final output sections 112*a* and 112*b*, second final output sections 112*c* and 112*d*, prestage output sections (first and second power supply change circuits) 113*a* and 113*b*, prestage output sections (third and fourth power supply change circuits) 113*c* and 113*d*, a control signal generation section 114*a* for generating a control signal to the prestage output sections 113*a* and 113*b*, a control signal generation section 114*b* for generating a control signal to the prestage output sections 113*c* and 113*d*, a voltage supply (first modulation signal power supply) 115*a* for supplying a modulation signal voltage, a voltage supply (second modulation signal power supply) 115*b* for supplying a modulation signal voltage, a voltage supply (first variable power supply) 116*a* for supplying a high-level voltage which is output from the prestage output section 113*a*, a voltage supply (second constant power supply) 116*b* for supplying a high-level voltage which is output from the prestage output section 113*b*, a voltage supply (third variable power supply) 116*c* for supplying a high-level voltage which is output from the prestage output section 113*c*, a voltage supply (fourth constant power supply) 116*d* for supplying a high-level voltage which is output from the prestage output section 113*d*, a voltage supply (first constant power supply) 117*a* for supplying a low-level voltage which is output from the prestage output section 113*a*, a voltage supply (second variable power supply) 117*b* for supplying a low-level voltage which is output from the prestage output section 113*b*, a voltage supply (third constant power supply) 117*c* for supplying a low-level voltage which is output from the prestage output section 113*c*, a voltage supply (fourth variable power supply) 117*d* for supplying a low-level voltage which is output from the prestage output section 113*d*, an inverter (first control signal inverting circuit) 118*a* which inverts a control signal, and an inverter (second control signal inverting circuit) 118*b* which inverts a control signal.

This embodiment represents an arrangement having two output voltage levels.

This embodiment differs from the fourth and fifth embodiments in that the circuit for outputting voltage V0 and the circuit for outputting voltage V1 are independent of each other. In this embodiment, these circuits can operate independently in association with the control signal generation circuits 114*a* and 114*b*.

The configuration and the operation principle of this embodiment are the same as those of the fourth embodiment, and the description for them will not be repeated.

The effects of this embodiment will be described.

If the present invention is implemented on the basis of this embodiment, the ON resistance of the modulation circuit can be changed by changing the power supply voltage even when the drive load varies. Thus, the driving ability of the modulation circuit can always be optimized to solve the above-described problems. Also, p-channel and n-channel transistors are used in combination in the output sections, so that a change in the ON resistance of each MOSFET due to the back gate effect can be canceled out, thereby enabling more strict gradation control.

Needless to say, while this embodiment has been described with respect to the case where two output voltage levels are set, it may be modified to enable setting of three or more levels.

(Other Embodiments)

Arrangements for limiting undesirable variation in signal potential at the time of application of the modulation signal have been described as the embodiments of the present invention. However, it is also possible to limit undesirable variation in signal potential at the time of application of a scanning signal by using a similar arrangement.

What is claimed is:

1. An image display apparatus comprising:

wiring;

a circuit which applies a predetermined potential to said wiring as a potential of a signal to be supplied to said wiring; and an image forming device which is set in a driven state when a voltage is applied to said image forming device by supplying the signal to said wiring, the circuit having:

a final output section which outputs the signal to said wiring, a pre-stage output section which is connected as a stage before said final output section, and which outputs a control signal for on/off control of said final output section, and a power supply which supplies a potential to said pre-stage output section, wherein said final output section has such a characteristic that its ON resistance is determined according to an amplitude value of the control signal input from said pre-stage output section, said pre-stage output section has a final output section control circuit which changes the amplitude of the control signal according to the potential supplied from said power supply, and said power supply comprises a variable power supply capable of changing the potential to be supplied, and a constant power supply for supplying a predetermined potential, and said final output section control circuit includes a power supply change circuit which selectively outputs the potentials supplied from said variable power supply and said constant power supply.

2. An image display apparatus, comprising:

wiring;

a circuit which applies a predetermined potential to said wiring as a potential of a signal to be supplied to said wiring; and an image forming device which is set in a driven state when a voltage is applied to said image forming device by supplying the signal to said wiring, the circuit having:

a final output section which outputs the signal to said wiring, a pre-stage output section which is connected as a stage before said final output section, and which outputs a control signal for on/off control of said final output section, and a power supply which supplies a potential to said pre-stage output section, wherein said final output section has such a characteristic that its ON resistance is determined according to an amplitude value of the control signal input from said pre-stage output section, said pre-stage output section has a final output section control circuit which changes the amplitude of the control signal according to the potential supplied from said power supply, said power supply comprises a variable power supply capable of changing the potential to be supplied, and a constant power supply for supplying a predetermined potential, and said final output section control circuit includes a power supply change circuit which selectively outputs the potentials supplied from said variable power supply and said constant power supply, said final output section has a first MOSFET and a second MOSFET having a channel characteristic different from that of said first MOSFET, said first and second MOSFETs being connected in parallel to each other between said power supply for supplying the signal and said wiring, said variable power supply comprises first and second variable power supplies capable of changing potentials to be supplied, and said constant power supply comprises first and second constant power supplies for supplying predetermined potentials, and said pre-stage output section includes a first power supply change circuit which selectively outputs the potentials from said first variable power supply and said first constant power supply to a gate terminal of said first MOSFET, a second power supply change circuit which selectively outputs the potentials from said second variable power supply and said second constant power supply to a gate terminal of said second MOSFET, and a control signal inverting circuit which diverges a pre-stage output section control signal externally supplied for control of said pre-stage output section to input to said second power supply change circuit a signal inverted relative to the signal input to said first power supply change circuit.

3. An image display apparatus, comprising:

wiring;

a circuit which applies a predetermined potential to said wiring as a potential of a signal to be supplied to said wiring; and an image forming device which is set in a driven state when a voltage is applied to said image forming device by supplying the signal to said wiring, the circuit having:

a final output section which outputs the signal to said wiring, a pre-stage output section which is connected as a stage before said final output section, and which outputs a control signal for on/off control of said final output section, and a power supply which supplies a potential to said pre-stage output section, wherein said final output section has such a characteristic that its ON resistance is determined according to an amplitude value of the control signal input from said pre-stage output section, said pre-stage output section has a final output section control circuit which changes the amplitude of the control signal according to the potential supplied from said power supply, said power supply comprises a variable power supply capable of changing the potential to be supplied, and a constant power supply for supplying a predetermined potential, and said final output section control circuit includes a power supply change circuit which selectively outputs the potentials supplied from said variable power supply and said constant power supply, and said power supply change circuit is comprised of a MOSFET.

4. An image display apparatus, comprising:

wiring;

a circuit which applies a predetermined potential to said wiring as a potential of a signal to be supplied to said wiring; and an image forming device which is set in a driven state when a voltage is applied to said image forming device by supplying the signal to said wiring, the circuit having:

a final output section which outputs the signal to said wiring, a pre-stage output section which is connected as a stage before said final output section, and which outputs a control signal for on/off control of said final output section, and a power supply which supplies a potential to said pre-stage output section, wherein said final output section has such a characteristic that its ON resistance is determined according to an amplitude value of the control signal input from said pre-stage output section, said pre-stage output section has a final output section control circuit which changes the amplitude of the control signal according to the potential supplied from said power supply, said power supply comprises a variable power supply capable of changing the potential to be supplied, and a constant power supply for supplying a predetermined potential, and said final output section control circuit includes a power supply change circuit which selectively outputs the potentials supplied from said variable power supply and said constant power supply, said final output section includes a first final output section having a first MOSFET and a second MOSFET having a channel characteristic different from that of the first MOSFET, said first and second MOSFETs being connected in parallel to each other between a first power supply for supplying the signal and said wiring, and a second final output section having a third MOSFET and a fourth MOSFET having a channel characteristic different from that of said third MOSFET, said third and fourth MOSFETs being connected in parallel to each other between a second power supply for supplying the signal and said wiring, said pre-stage output section includes a first pre-stage output section which outputs a first control signal to said first final output section, and a second pre-stage output section which outputs a second control signal to said second final output section, said variable power supply comprises, as power supplies connected to said first pre-stage output section, first and second variable power supplies capable of changing potentials to be supplied, and said constant power supply comprises first and second constant power supplies for supplying predetermined potentials, and said variable power supply further comprises, as power supplies connected to said second pre-stage output section, third and fourth variable power supplies capable of changing potentials to be supplied, and said constant power supply further comprises third and fourth constant power supplies for supplying predetermined potentials, said first pre-stage output section includes a first power supply change circuit which selectively outputs the potentials from said first variable power supply and said first constant power supply to a gate terminal of said first MOSFET, a second power supply change circuit which selectively outputs the potentials from said second variable power supply and said second constant power supply to a gate terminal of said second MOSFET, and a first control signal inverting circuit which diverges a first pre-stage output section control signal externally supplied for control of said first pre-stage output section to input to said second power supply change circuit a signal inverted relative to the signal input to said first power supply change circuit, and said second pre-stage output section includes a third power supply change circuit which selectively outputs the potentials from said third variable power supply and said third constant power supply to a gate terminal of said third MOSFET, a fourth power supply change circuit which selectively outputs the potentials from said fourth variable power supply and said fourth constant power supply to a gate terminal of said fourth MOSFET, and a second control signal inverting circuit which diverges a second pre-stage output section control signal externally supplied for control of said second pre-stage output section to input to said fourth power supply change circuit a signal inverted relative to the signal input to said third power supply change circuit.

5. An image display apparatus according to claim 4, wherein at least one of said first, second, third, and fourth power supply change circuits is comprised of a MOSFET.

* * * * *